US008207918B2

(12) United States Patent
Kohno et al.

(10) Patent No.: US 8,207,918 B2
(45) Date of Patent: Jun. 26, 2012

(54) IMAGE DISPLAY DEVICE HAVING A SET PERIOD DURING WHICH A STEP SIGNAL IS SUPPLIED AT DIFFERENT LEVELS TO PROVIDE A UNIFORM DISPLAY

(75) Inventors: Tohru Kohno, Kokubunji (JP); Takahide Kuranaga, Kokubunji (JP); Hiroshi Kageyama, Hachioji (JP); Hajime Akimoto, Kokubunji (JP)

(73) Assignees: Hitachi Displays, Ltd., Chiba (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 466 days.

(21) Appl. No.: 12/480,804

(22) Filed: Jun. 9, 2009

(65) Prior Publication Data

US 2009/0309865 A1 Dec. 17, 2009

(30) Foreign Application Priority Data

Jun. 11, 2008 (JP) ..... 2008-152942
Aug. 19, 2008 (JP) ..... 2008-210478

(51) Int. Cl.
*G09G 3/30* (2006.01)

(52) U.S. Cl. ..... 345/78; 345/82

(58) Field of Classification Search ..... 345/208, 345/214, 76–78, 82, 83
See application file for complete search history.

(56) References Cited

U.S. PATENT DOCUMENTS 6,876,345 B2 4/2005 Akimoto et al.
6,950,081 B2 9/2005 Akimoto et al.
7,436,376 B2 10/2008 Akimoto et al.
2004/0217925 A1* 11/2004 Chung et al. ..... 345/76
2008/0036706 A1* 2/2008 Kitazawa ..... 345/76

FOREIGN PATENT DOCUMENTS

JP 2003-005709 1/2003
JP 2003-122301 4/2003

OTHER PUBLICATIONS

R.M.A. Dawson et al., "4.2: Design of an Improved Pixel for a Polysillicon Active-Matrix Organic LED Display", Symposium Digest of Technical Papers, SID98, vol. 29, issue 1, pp. 11-14, May 1998.

Kohno et al., "L-1: Late-News Paper: 3.0-inch High-resolution Low-voltage LTPS AM-OLED Display with Novel Voltage-programmed Driving Architecture", Symposium Digest of Technical Papers, SID07, vol. 38, issue 1, pp. 1382-1385, May 2007.

* cited by examiner

*Primary Examiner* — Chanh Nguyen
*Assistant Examiner* — Allison Walthall
(74) *Attorney, Agent, or Firm* — Antonelli, Terry, Stout & Kraus, LLP.

(57) ABSTRACT

During a first period of a set period, a reset switch element of each pixel is turned on to converge a voltage at a control electrode of a TFT to a predetermined voltage, and a step signal having a first voltage level is supplied from a step signal generation circuit. During a second period of the set period, the reset switch element is turned off, and a step signal having a second voltage level is supplied from the step signal generation circuit, whereby a voltage exceeding a second power supply voltage or a voltage exceeding a voltage range supplied from a signal driver section is input as a characteristic value set voltage to the control electrode. Accordingly, even when a relationship between a gate voltage and a drain current of the thin film transistor exhibits a hysteresis characteristic, uniform display can be achieved.

13 Claims, 17 Drawing Sheets

IMAGE DISPLAY DEVICE HAVING A SET PERIOD DURING WHICH A STEP SIGNAL IS SUPPLIED AT DIFFERENT LEVELS TO PROVIDE A UNIFORM DISPLAY

CROSS-REFERENCE TO RELATED APPLICATION

The present application claims priority from Japanese patent applications JP 2008-210478 filed on Aug. 19, 2008, and JP 2008-152942 filed on Jun. 11, 2008, the contents of which are hereby incorporated by reference into this application.

BACKGROUND OF THE INVENTION

1. Field of the Invention

The present invention relates to an image display device using an organic EL element, and more particularly, to an image display device capable of performing high-quality display at a reduced voltage with improved definition.

2. Description of the Related Art

In recent years, the demand for a flat panel display device instead of a cathode ray tube (CRT) display device which is the mainstream of a conventional display device has been increasing. In particular, a display device using an organic electro luminescence (EL) element such as an organic light emitting diode (OLED) is excellent in power consumption, weight, thinness, moving picture characteristics, and viewing angle. Therefore, a higher-performance display device has been actively developed, with the result that device characteristics are improved.

A method of writing a pixel signal into a pixel in an image display device using the organic EL element is divided into a voltage program method and a current program method. In general, according to the voltage program method, a write speed is faster. A technology using the voltage program method is described in, for example, Digest of Technical Papers, SID98, pp. 11-14.

According to a method of driving an organic EL display device, which is described in Digest of Technical Papers, SID98, pp. 11-14, during a write period, a voltage of a gate electrode of a thin film transistor for driving an organic EL element (hereinafter referred to as driver TFT) in each of pixels of an organic EL display panel is automatically reset to a voltage (Vdd-Vth) lower than a power supply line voltage (Vdd) by a threshold voltage (Vth). Therefore, a variation in driver TFTs is suppressed, and the light emission of high uniformity can be realized.

SUMMARY OF THE INVENTION

However, the organic EL display device described in Digest of Technical Papers, SID98, pp. 11-14 causes a problem that characteristics of the driver TFTs are varied because of a reduction in power and an increase in definition to reduce screen uniformity and thus high quality image cannot be maintained.

The problem is described with reference to FIGS. 13A to 13C and FIGS. 14A to 14D.

There is a case where a thin film transistor (hereinafter referred to as TFT) normally has a gate-voltage drain-current relationship which exhibits a hysteresis characteristic.

The hysteresis characteristic is described with reference to FIGS. 13A to 13C.

A relationship between a gate voltage (Vg) and a drain current (Id) of the TFT is changed depending on the number of carriers (CAP) trapped by a gate insulator film (GI).

As illustrated in FIG. 13A, in a state in which the number of carriers (CAP) trapped in the gate insulator film (GI) is large (hereinafter referred to as State-A), the relationship between the gate voltage (Vg) and the drain current (Id) of the TFT is based on Characteristic-A illustrated in FIG. 13C.

In contrast to this, as illustrated in FIG. 13B, in a state in which the number of carriers (CAP) trapped in the gate insulator film (GI) is small (hereinafter referred to as State-B), the relationship between the gate voltage (Vg) and the drain current (Id) of the TFT is based on Characteristic-B illustrated in FIG. 13C.

When the trapped carriers (CAP) are discharged to reduce the number of the trapped carriers (CAP), the relationship between the gate voltage (Vg) and the drain current (Id) is shifted from Characteristic-A to Characteristic-B. Therefore, when the number of the trapped carriers (CAP) is small, the TFT may operate with any characteristic included in Region-C between Characteristic-A and Characteristic-B as illustrated in FIG. 13C.

FIG. 13C illustrates the characteristics of the TFT which is of a p-type. The abscissa indicates the gate voltage (Vg) which is negative with respect to a source voltage. In each of FIGS. 13A and 13B, reference symbol G denotes a gate electrode.

In the case where the p-type TFT has the hysteresis characteristic in the relationship between the gate voltage (Vg) and the drain current (Id) as described above, when a signal input to the gate electrode of the p-type TFT is changed from a voltage Vg1 to a voltage Vg0 as illustrated in FIG. 14A, the drain current (Id) is overshot to drop the carriers (CAP) trapped in the gate insulator film (GI). As a result, the carriers (CAP) are trapped again in the gate insulator film (GI), whereby the relationship between the gate voltage (Vg) and the drain current (Id) approaches Characteristic-A illustrated in FIG. 14B.

When a time (ton) for which the voltage Vg1 is applied is long and a potential difference (ΔVg) between the voltages Vg1 and Vg0 is large, overshoot becomes further larger. Therefore, as illustrated in FIG. 14B, even after a lapse of a predetermined time, the relationship between the gate voltage (Vg) and the drain current (Id) is maintained as a characteristic close to Characteristic-B.

In contrast to this, in a case where the time (ton) for which a voltage Vg2 is applied is short and the potential difference (ΔVg) between the voltages Vg2 and Vg0 is small, such as a case where a signal input to the gate electrode is changed from the voltage Vg2 to the voltage Vg0 as illustrated in FIG. 14C, overshoot becomes smaller. Therefore, as illustrated in FIG. 14D, the relationship between the gate voltage (Vg) and the drain current (Id) rapidly approaches Characteristic-A. In FIG. 14B and FIG. 14D, Id0 denotes the drain current when the gate voltage is Vg0.

In the organic EL display device described in Digest of Technical Papers, SID98, pp. 11-14, when a power supply voltage is reduced or when a precharge time is shortened because of high definition, the characteristics of the driver TFT approaches Characteristic-A illustrated in FIG. 14D. In such a case, the driver TFT may operate with a characteristic close to Characteristic-A, such as Characteristic-C2, of characteristics included in the region between Characteristic-A and Characteristic-B as illustrated in FIG. 14D.

As described above, the organic EL display device driven by the conventional method includes a pixel which emits light at a large gate voltage ΔVg applied to the gate electrode of the driver TFT and a pixel which does not emit light at the gate voltage ΔVg. Therefore, in a case where light emission is to be performed in the same gray level, even when the voltage of the gate electrode of the driver TFT of each pixel is set to the same voltage (Vdd-Vth) lower than the power supply line voltage (Vdd) by the threshold voltage (Vth), the characteristics of the driver TFT of each pixel is changed according to a light emission state of a preceding frame. Thus, screen uniformity is reduced, and hence high quality image cannot be maintained.

The present invention has been made to solve the problem of the related art. An object of the present invention is to provide an image display device capable of performing more uniform display even when a relationship between a gate voltage and a drain current of a TFT exhibits hysteresis characteristic.

The above-mentioned and other objects and novel features of the present invention become apparent from the description of this specification and the accompanying drawings.

A typical aspect of the invention disclosed in this application is generally and briefly described as follows.

According to the present invention, a sufficient forward bias voltage is applied to the gate voltage of the driver TFT before a signal voltage is applied to a pixel. Therefore, the characteristics of the driver TFT of each pixel is fit to Characteristic-C1 illustrated in FIG. 14B to drive the driver TFT with the characteristic close to Characteristic-B.

A specific structure is as follows.

(1) An image display device comprises: a plurality of pixels each including a light-emitting element having a first end and a second end; a plurality of signal lines for inputting image signals to the plurality of pixels; a signal driver section for supplying the image signals to the plurality of signal lines; and a step signal generation circuit for supplying a step signal to each of the plurality of signal lines, each of the plurality of pixels including: a driver transistor which includes a control electrode, a first electrode, and a second electrode, for driving the light-emitting element based on corresponding one of the image signals; a capacitor element connected between corresponding one of the plurality of signal lines and the control electrode of the driver transistor; and a reset switch element connected between the control electrode and the second electrode of the driver transistor, the first electrode of the driver transistor being applied with a first power supply voltage, the first end of the light-emitting element being applied with a second power supply voltage. In the image display device, a frame period includes: a set period; and a write period which follows the set period, for writing the image signals to the plurality of pixels on each of a plurality of display lines, during a first period of the set period, the reset switch element of each of the plurality of pixels on the corresponding display line is turned on to converge a voltage at the control electrode of the driver transistor of each of the plurality of pixels on the corresponding display line to a predetermined voltage, and a step signal having a first voltage level is supplied from the step signal generation circuit to each of the plurality of signal lines, and during a second period of the set period, the reset switch element of each of the plurality of pixels on the corresponding display line is turned off, and a step signal having a second voltage level different from the first voltage level is supplied from the step signal generation circuit to each of the plurality of signal lines, to input, to the control electrode of the driver transistor of each of the plurality of pixels on the corresponding display line, one of a voltage exceeding the second power supply voltage and a voltage exceeding a voltage range supplied from the signal driver section, as a characteristic value set voltage.

(2) An image display device comprises: a plurality of pixels each including a light-emitting element having a first end and a second end; a plurality of signal lines for inputting image signals to the plurality of pixels; a signal driver section for supplying the image signals to the plurality of signal lines; and a step signal generation circuit for supplying a step signal to each of the plurality of signal lines, each of the plurality of pixels including: a driver transistor which includes a control electrode, a first electrode, and a second electrode, for driving the light-emitting element based on corresponding one of the image signals; a first capacitor element connected between the control electrode and the first electrode of the driver transistor; a second capacitor element having a first end and a second end, the first end being connected to the control electrode of the driver transistor; a select switch element connected between corresponding one of the plurality of signal lines and the second end of the second capacitor element; and a reset switch element connected between the control electrode and the second electrode of the driver transistor, the first electrode of the driver transistor being applied with a first power supply voltage, the first end of the light-emitting element being applied with a second power supply voltage. In the image display device, a frame period includes: a set period; and a write period which follows the set period, for writing the image signals to the plurality of pixels on each of a plurality of display lines, during a first period of the set period, the select switch element and the reset switch element of each of the plurality of pixels on the corresponding display line are turned on to converge a voltage at the control electrode of the driver transistor of each of the plurality of pixels on the corresponding display line to a predetermined voltage, and a step signal having a first voltage level is supplied from the step signal generation circuit to the corresponding one of the plurality of signal lines, which is connected to the select switch element of each of the plurality of pixels on the corresponding display line, and during a second period of the set period, the select switch element of each of the plurality of pixels on the corresponding display line is turned on, the reset switch element of each of the plurality of pixels on the corresponding display line is turned off, and a step signal having a second voltage level different from the first voltage level is supplied from the step signal generation circuit to each of the plurality of signal lines, to input, to the control electrode of the driver transistor of each of the plurality of pixels on the corresponding display line, one of a voltage exceeding the second power supply voltage and a voltage exceeding a voltage range supplied from the signal driver section, as a characteristic value set voltage.

(3) An image display device comprises: a plurality of pixels each including a light-emitting element having a first end and a second end; a plurality of signal lines for inputting image signals to the plurality of pixels; a signal driver section for supplying the image signals to the plurality of signal lines; and a step signal generation circuit for supplying a step signal to each of the plurality of signal lines, each of the plurality of pixels including: a driver transistor which includes a control electrode, a first electrode, and a second electrode, for driving the light-emitting element based on corresponding one of the image signals; a first capacitor element connected between the control electrode and the first electrode of the driver transistor; a second capacitor element having a first end and a second end, the first end being connected to the control electrode of the driver transistor; a select switch element connected between corresponding one of the plurality of signal lines and the second end of the second capacitor element; a reset switch element connected between the control electrode and the second electrode of the driver transistor; alighting control switch element connected between the second electrode of the driver transistor and the first end of the light-emitting element; and a precharge switch element connected between the corresponding one of the plurality of signal lines and the first end of the light-emitting element, the first electrode of the driver transistor being applied with a first power supply voltage, the first end of the light-emitting element being applied with a second power supply voltage. In the image display device, a frame period includes: a set period; and a write period which follows the set period, for writing the image signals to the plurality of pixels on each of a plurality of display lines, during a first period of the set period, the select switch element, the reset switch element, the lighting control switch element, and the precharge switch element of each of the plurality of pixels on the corresponding display line are turned on, and a step signal having a second voltage level is supplied from the step signal generation circuit to the corresponding one of the plurality of signal lines, which is connected to the select switch element of each of the plurality of pixels on the corresponding display line, to input a voltage having the second voltage level to the control electrode of the driver transistor of each of the plurality of pixels on the corresponding display line, during a second period of the set period, the select switch element, the reset switch element, the lighting control switch element, and the precharge switch element of each of the plurality of pixels on the corresponding display line are turned off, and a step signal having a first voltage level different from the second voltage level is supplied from the step signal generation circuit to each of the plurality of signal lines, and during a third period of the set period, the select switch element of each of the plurality of pixels on the corresponding display line is turned on, the reset switch element, the lighting control switch element, and the precharge switch element of each of the plurality of pixels on the corresponding display line are turned off, and a step signal having the second voltage level is supplied from the step signal generation circuit to each of the plurality of signal lines for each of the plurality of pixels on the corresponding display line, to input, to the control electrode of the driver transistor of each of the plurality of pixels on the corresponding display line, one of a voltage exceeding the second power supply voltage and a voltage exceeding a voltage range supplied from the signal driver section, as a characteristic value set voltage.

(4) In the image display device according to Items (1) to (3), the driver transistor comprises a p-type field effect transistor, the light-emitting element includes a cathode electrode applied with the second power supply voltage, the first voltage level of the step signal is a High level and the second voltage level of the step signal is a Low level, and the characteristic value set voltage input to the control electrode of the driver transistor of each of the plurality of pixels on the corresponding display line is one of a voltage lower in potential than the second power supply voltage and a voltage lower in potential than a minimum voltage in the voltage range supplied from the signal driver section.

An effect obtained by the typical aspect of the invention disclosed in this application is briefly described as follows.

According to the image display device of the present invention, uniform display can be achieved without display defect resulting from the hysteresis characteristic of the TFT.

DETAILED DESCRIPTION OF THE INVENTION

Hereinafter, organic electro luminescence (EL) display devices according to embodiments of the present invention are described in detail with reference to the accompanying drawings.

In each of the drawings for describing the embodiments, constituent elements having the same functions are expressed by the same reference symbols, and thus the duplicated description thereof is omitted.

Embodiment 1

Figure 1:
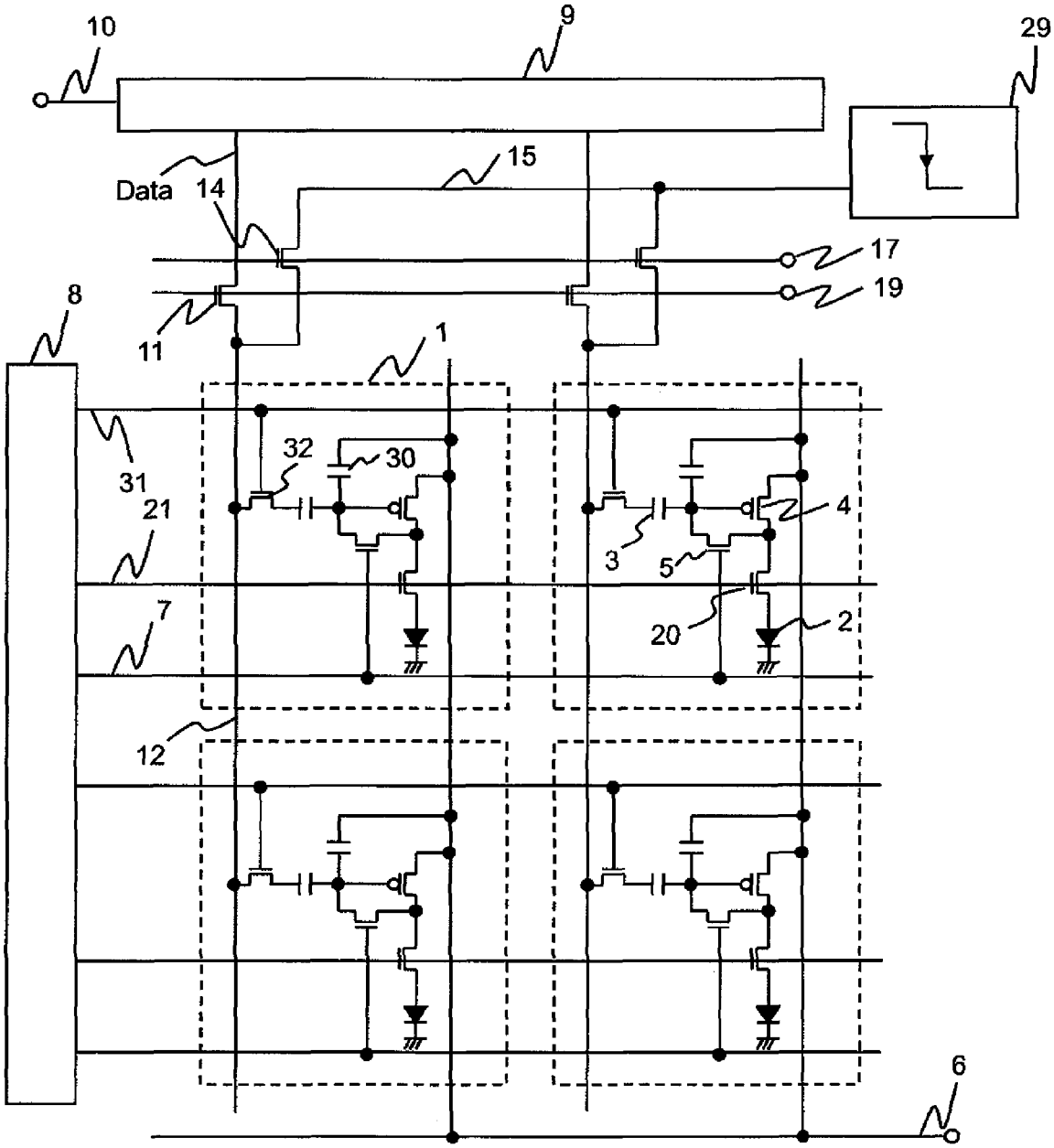
FIG. 1 is a diagram illustrating an entire structure of an organic EL display device according to Embodiment 1 of the present invention.

FIG. 1 is a diagram illustrating an entire structure of an organic EL display device according to Embodiment 1 of the present invention. As illustrated in FIG. 1, a plurality of pixels 1 are provided in matrix in a display region of an organic EL display panel.

Signal lines 12, reset lines 7, select switch lines 31, lighting switch lines 21, and a power supply line 6 are provided for the pixels 1.

The reset lines 7, the select switch lines 31, and the lighting switch lines 21 are connected to a gate driver section 8.

An image signal is supplied from an outside to a signal driver section 9 through a signal input line 10. A step signal input line 15, a step signal selection switch control line 17, and a signal line selection switch control line 19 are provided between the signal driver section 9 and the organic EL display panel to extend in a direction perpendicular to the signal lines 12.

Any one of the image signal output from the signal driver section 9 through a signal line Data and a signal line selection switch element 11 including a TFT and a step signal output from a step signal generation section 29 through the step signal input line 15 and a step signal selection switch element 14 including a TFT is input to the signal line 12.

The signal line selection switch elements 11 are controlled through the signal line selection switch control line 19. The step signal selection switch elements 14 are controlled through the step signal selection switch control line 17.

In an actual case, a large number of pixels 1 are arranged in the display region of the organic EL display panel. For the sake of simplification, only four pixels are illustrated in FIG. 1. As described later, a common ground line is provided for the pixels 1, but the description thereof is omitted.

Each of the pixels 1 includes an organic EL element 2 serving as a light-emitting element. A cathode electrode of the organic EL element 2 is connected to the common ground line.

An anode electrode of the organic EL element 2 is connected to the power supply line 6 through a lighting control switch element 20 including an n-type TFT and a driver TFT 4 including a p-type TFT.

A first capacitor element 30 is connected between a gate electrode and a source electrode of the driver TFT 4. A reset switch element 5 including a TFT is provided between a drain electrode and the gate electrode of the driver TFT 4. The gate electrode of the driver TFT 4 is connected to the signal line 12 through a second capacitor element 3 and a select switch element 32.

A gate electrode of the reset switch element 5 is connected to the reset line 7. A gate electrode of the select switch element 32 is connected to the select switch line 31. A gate electrode of the lighting control switch element 20 is connected to the lighting switch line 21.

Each of the pixels 1 and each of circuits such as the gate driver section 8 and the signal driver section 9 include low-temperature polycrystalline silicon TFTs using a low-temperature polycrystalline silicon layer which is generally well known as a semiconductor layer. The TFTs are formed on a glass substrate.

The description of methods of manufacturing the low-temperature polycrystalline silicon TFTs and the organic EL elements 2 is omitted because the methods are not significantly different from generally reported methods.

Figure 11:
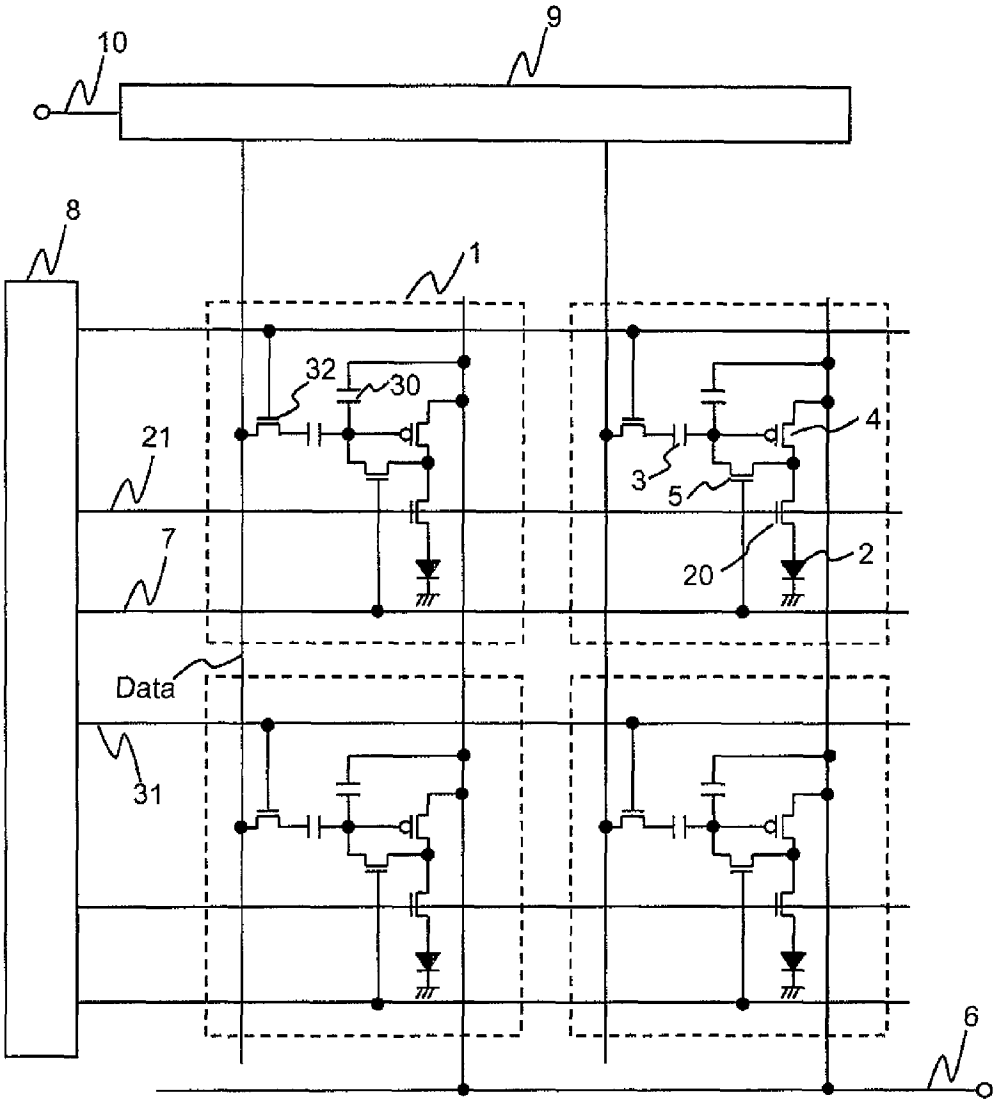
FIG. 11 PRIOR ART
FIG. 11 is a diagram illustrating an entire structure of an organic EL display device according to a related art.

FIG. 11 is a diagram illustrating an entire structure of an organic EL display device according to a related art. The conventional organic EL display device illustrated in FIG. 11 is different from the organic EL display device according to this embodiment illustrated in FIG. 1 in that the signal line selection switch elements 11, the step signal selection switch elements 14, the step signal input line 15, the step signal selection switch control line 17, the signal line selection switch control line 19, and the step signal generation section 29 are not provided.

Figure 12:
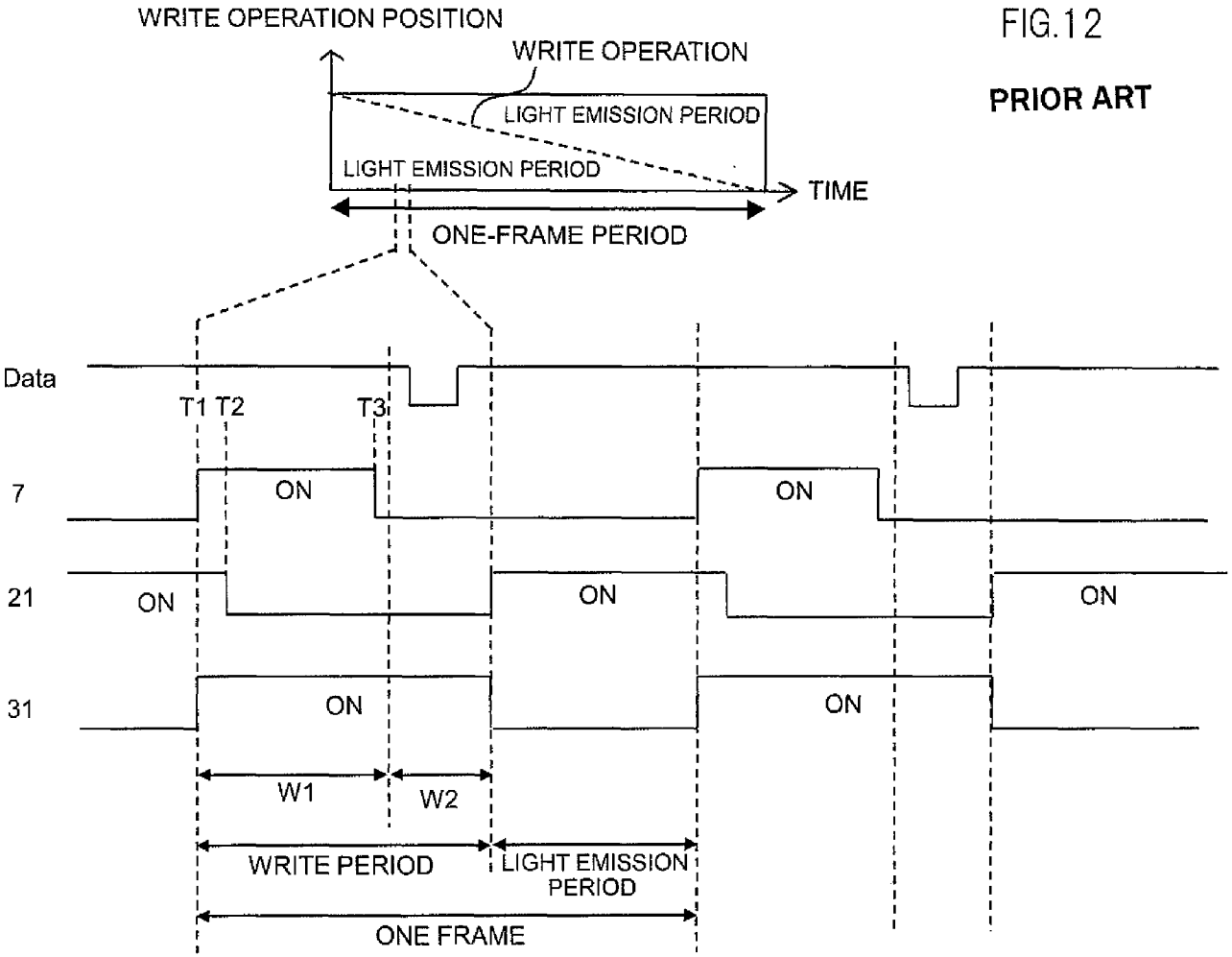
FIG. 12 PRIOR ART
FIG. 12 is a timing chart illustrating an operation of the organic EL display device according to the related art.
Figure 13A:
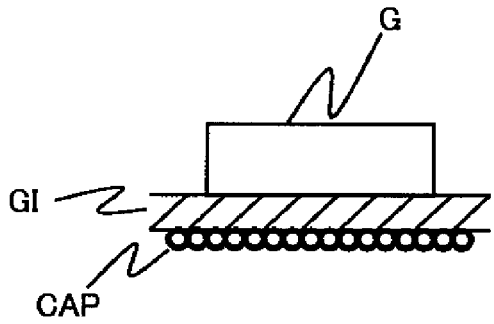
FIGS. 13A, 13B, and 13C illustrate a hysteresis characteristic of a thin film transistor.
Figure 13B:
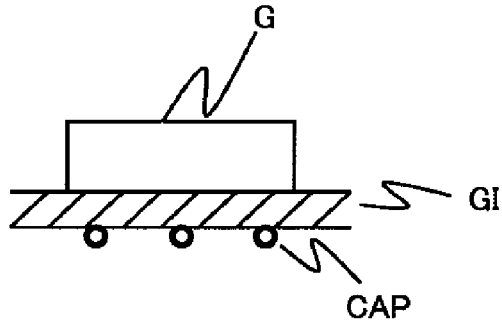
Figure 13C:
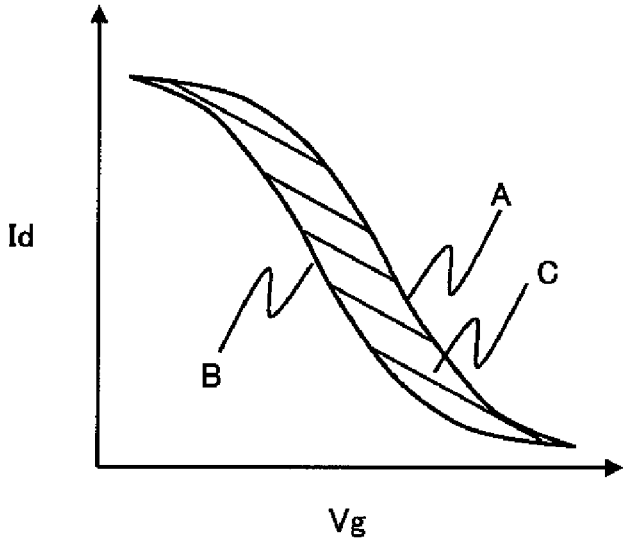

FIG. 12 is a timing chart illustrating an operation of the organic EL display device according to the related art.

As illustrated in FIG. 12, a write period and a light emission period are set within each frame period for each pixel of the conventional organic EL display device. During the write period, image signals are written into the respective pixels 1. During the light emission period, lighting is performed for display. The image signals are written for each display line, that is, for each of the reset lines 7.

Hereinafter, an operation during each of the periods is described.

[Write Period]

During the write period, the gate driver section 8 sequentially scans the plurality of pixels 1 of each row for each display line, and writes into the signal lines 12 image signals from the signal driver section 9 through the signal lines Data and the signal line selection switch elements 11 in synchronization with the scanning.

Hereinafter, an operation of one of the pixels ion an arbitrary display line selected by the gate driver section 8 during the "write period" is described.

During a period W1 of the write period, a predetermined voltage (reference voltage) is supplied form the signal driver section 9 to the signal line 12 through the signal line Data. During the period W1, the select switch element 32 is turned on.

During a period between times T1 and T2, the reset switch element 5 and the lighting control switch element 20 are in an on-state, whereby the driver TFT 4 has a diode connection in which the gate electrode and the drain electrode thereof are connected to each other.

At the time T2, when the lighting control switch element 20 is turned off, the driver TFT 4 and the organic EL element 2 are forced into a current off state. At this time, a voltage of the gate electrode of the driver TFT 4 which is a voltage of one end of the second capacitor element 3 is automatically reset to a voltage (Vdd−Vth) lower than a voltage (Vdd) of the power supply line 6 by a threshold voltage (Vth), because the gate electrode and the drain electrode of the driver TFT 4 are short-circuited by the reset switch element 5.

In this case, as described above, the predetermined voltage (reference voltage) is being input from the signal line 12 to the other end of the second capacitor element 3.

At a time T3, the reset switch element 5 is turned off. After that, during a period W2 of the write period, the image signal is supplied to the signal line 12 through the signal line Data and then input to the other end of the second capacitor element 3.

[Light Emission Period]

During the light emission period, the select switch element 32 is in an off-state and the lighting control switch element 20 is in an on-state, whereby the organic EL element 2 emits light.

During the light emission period, a voltage corresponding to a change in image signal with respect to the reference voltage is applied to the gate electrode of the driver TFT 4, and an amount of current corresponding to the applied voltage flows through the organic EL element 2, thereby adjusting light emission luminance.

As described above, according to the conventional method of driving the organic EL display device, during the period W1 of the write period, the voltage of the gate electrode of the driver TFT 4 in each of the pixels 1 included in the organic EL display panel is automatically reset to the voltage (Vdd−Vth) lower than the voltage (Vdd) of the power supply line 6 by the threshold voltage (Vth). Therefore, a variation in driver TFTs 4 is suppressed, and accordingly the light emission of high uniformity can be realized.

However, as described above, the TFT characteristic of each of the driver TFTs 4 is varied according to the number of carriers retained at the gate electrode.

The organic EL display device driven by the conventional method includes a pixel which emits light at a large gate voltage ΔVg applied to the gate electrode of the driver TFT 4 and a pixel which does not emit light at the gate voltage ΔVg. Therefore, in a case where light emission is to be performed for the same gray level, even when the voltage of the gate electrode of the driver TFT 4 of each pixel is set to the same voltage (Vdd−Vth) lower than the voltage (Vdd) of the power supply line 6 by the threshold voltage (Vth), the characteristic of the driver TFT 4 of each pixel is changed depending on a light emission state of a preceding frame. Thus, screen uniformity is reduced, resulting in that high quality image cannot be maintained. This can be visually recognized as a state in which a displayed moving picture is rough or a state in which the moving picture is burned in or has an afterimage.

Figure 2:
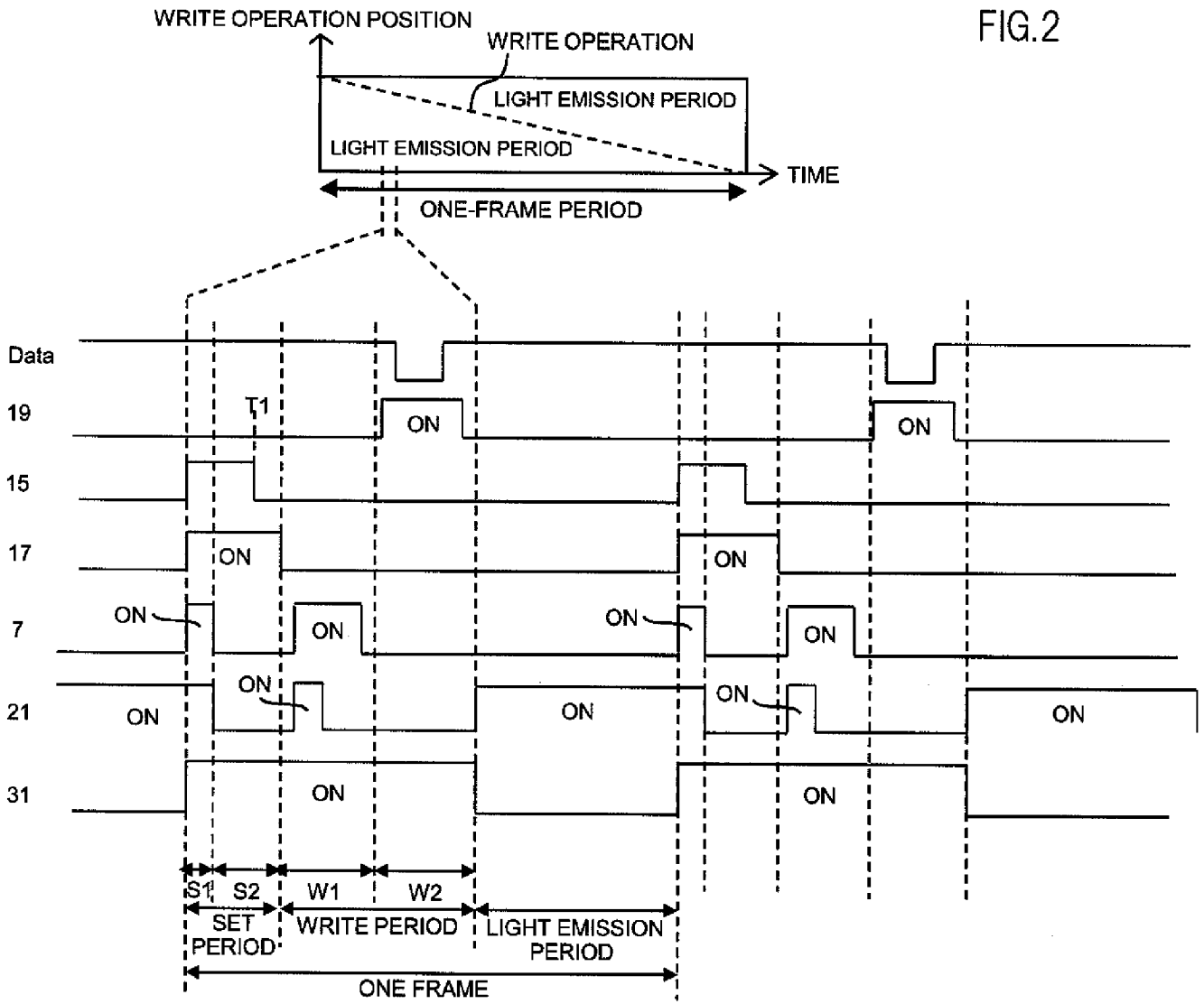
FIG. 2 is a timing chart illustrating an operation of the organic EL display device according to Embodiment 1 of the present invention.

FIG. 2 is a timing chart illustrating an operation of the organic EL display device according to this embodiment.

As illustrated in FIG. 2, this embodiment is different from the conventional method of driving the organic EL display device in that a set period, a write period, and a light emission period are set within each frame period for each pixel.

Hereinafter, an operation during each of the periods is described.

[Set Period]

Figure 14A:
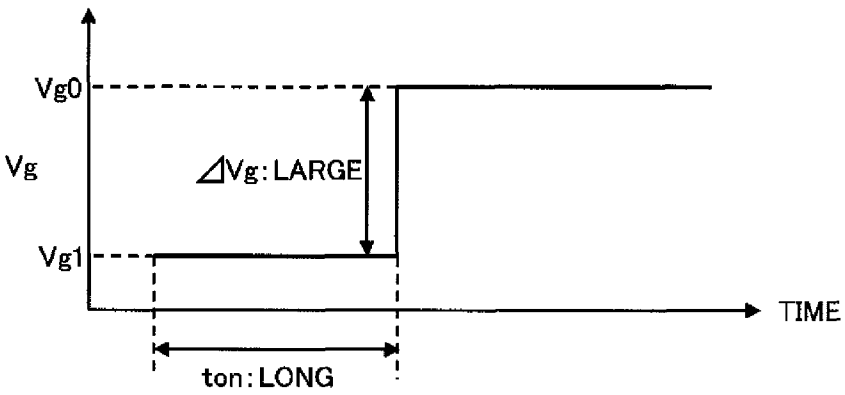
FIGS. 14A to 14D illustrate relationships between a gate voltage and drain current of the thin film transistor having the hysteresis characteristic.
Figure 14B:
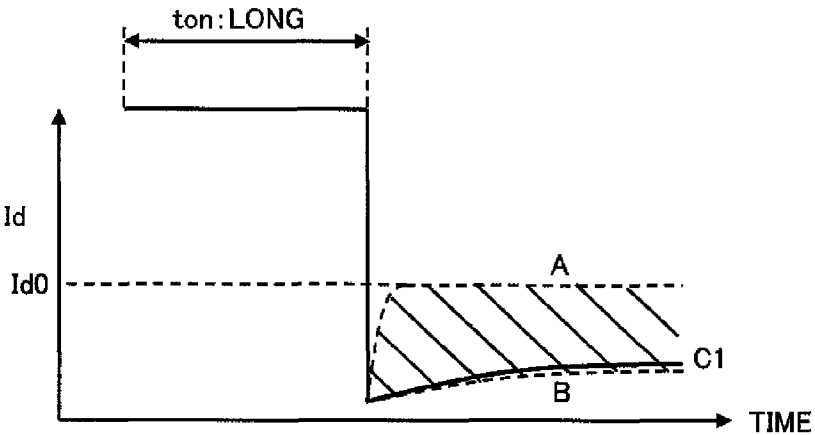
Figure 14C:
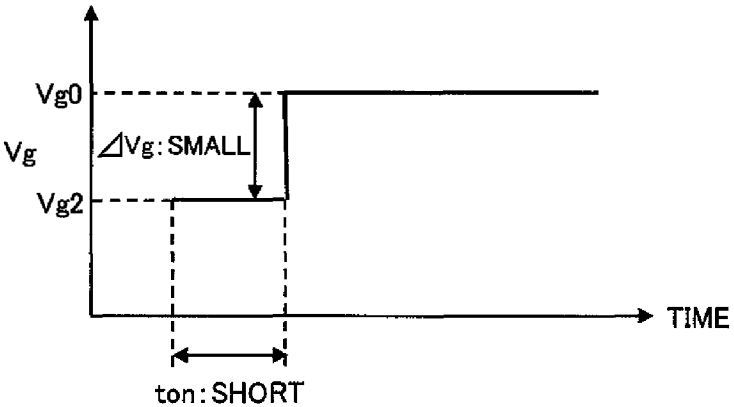
Figure 14D:
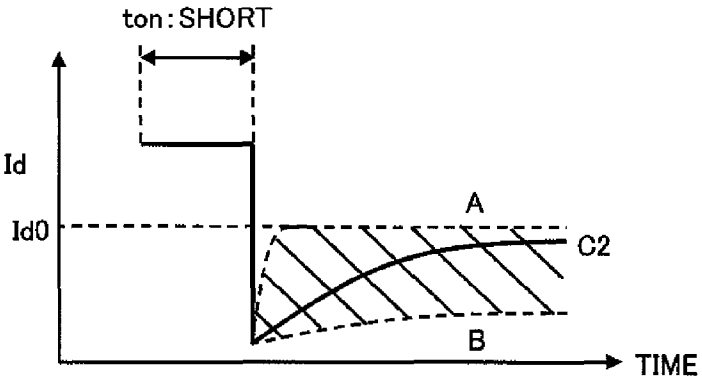

According to a feature of this embodiment, before the write period, a characteristic value of the driver TFT 4 of each pixel is fit to Characteristic-C1 illustrated in FIG. 14B to drive the driver TFT 4 with a characteristic close to Characteristic-B.

In this embodiment, the select switch element 32 of each of the pixels 1 is maintained in an on-state during the "set period" and the "write period".

During a period S1 of the set period, the reset switch element 5 and the lighting control switch element 20 are in an on-state.

In this case, the step signal selection switch control line 17 is in a High level (hereinafter referred to as H level), and the step signal selection switch element 14 is in an on-state. Then, a voltage Vsteph is applied from the step signal generation section 29 to the signal line 12 through the step signal input line 15.

The voltage Vsteph is, for example, a maximum voltage of voltages which can be supplied from the signal driver section 9, or a voltage of the power supply line 6. In this case, the voltage of the gate electrode of the driver TFT 4 is converged to a voltage V1.

During a period S2 of the set period, the reset switch element 5 and the lighting control switch element 20 are in an off-state. At a time T1 within the period S2, the voltage output from the step signal generation section 29 is switched from the voltage Vsteph to a voltage Vstep1.

Therefore, during the period S2, the voltage supplied to the signal line 12 through the step signal input line 15 is changed from the voltage Vsteph to the voltage Vstep1. The voltage Vstep1 is, for example, a minimum voltage of voltages which can be supplied from the signal driver section 9, or a voltage of the common ground line.

In this case, a voltage of "V1−(Vsteph−Vstep1)" [V] is applied to the gate electrode of the driver TFT 4. When the voltage of the power supply line 6 is expressed by Vdd and the voltage of the common ground line is set to 0 [V], V1≈Vdd/2 is satisfied. In a case of (Vsteph−Vstep1)≈Vdd, the gate electrode of the driver TFT 4 can be maintained at a voltage of −(Vdd/2).

At an initial stage of a program operation, in a normal case, an initial voltage of only approximately (Vdd/2) can be applied between the gate electrode and the source electrode of the driver TFT 4. In contrast, according to this embodiment, a voltage of (3Vdd/2) can be applied between the gate electrode and the source electrode. Therefore, even when a driver TFT significantly affected by hysteresis is used as the driver TFT 4, the characteristic of the driver TFT can be fit to Characteristic-C1 illustrated in FIG. 14B to drive the driver TFT with the characteristic close to Characteristic-B. Thus, uniform light emission can be realized.

[Write Period and Light Emission Period]

The operation during the write period in this embodiment is different from the operation during the write period in the related art illustrated in FIG. 12 in the following two points. In the first point, during a period W1 of the write period, the step signal selection switch control line 17 and the signal line selection switch control line 19 are in a Low level (hereinafter referred to as L level) and thus the signal line selection switch element 11 and the step signal selection switch element 14 are maintained in an off-state, whereby the signal line 12 is in a floating state. In the second point, during a period W2 of the write period, the signal line selection switch control line 19 becomes in an H level and thus the signal line selection switch element 11 is turned on, whereby the image signal is supplied to the signal line 12. The other operation is identical to the operation during the write period in the related art illustrated in FIG. 12, and hence the repeated description is omitted.

Similarly, the operation during the light emission period in this embodiment is identical to the operation during the light emission period in the related art illustrated in FIG. 12, and hence the repeated description is omitted.

As described above, according to this embodiment, before the write period, the characteristic of the driver TFT 4 of each of the pixels 1 can be fit to Characteristic-C1 illustrated in FIG. 14B to drive the driver TFT 4 with the characteristic close to Characteristic-B. Therefore, display defect resulting from the hysteresis characteristic of the driver TFT 4 is suppressed, and hence more uniform display can be achieved.

In this embodiment, the driver TFT 4 and the organic EL element 2 are connected to each other through the lighting control switch element 20. However, even when the lighting control switch element 20 is not provided, the same effect is obtained. Even when the lighting control switch element 20 is connected between the power supply line 6 and the source electrode of the driver TFT 4, the same effect is obtained.

Peripheral driver circuits including the gate driver section 8 and the signal driver section 9 include a low-temperature polycrystalline silicon (polysilicon) TFT circuit. The peripheral driver circuits or a part thereof may be mounted as a single-crystalline large scale integrated (LSI) circuit. In this case, each of the driver TFT 4, the reset switch element 5, and the lighting control switch element 20 may be formed on a glass substrate, as an amorphous silicon TFT using a semiconductor layer made of amorphous silicon.

Embodiment 2

Figure 3:
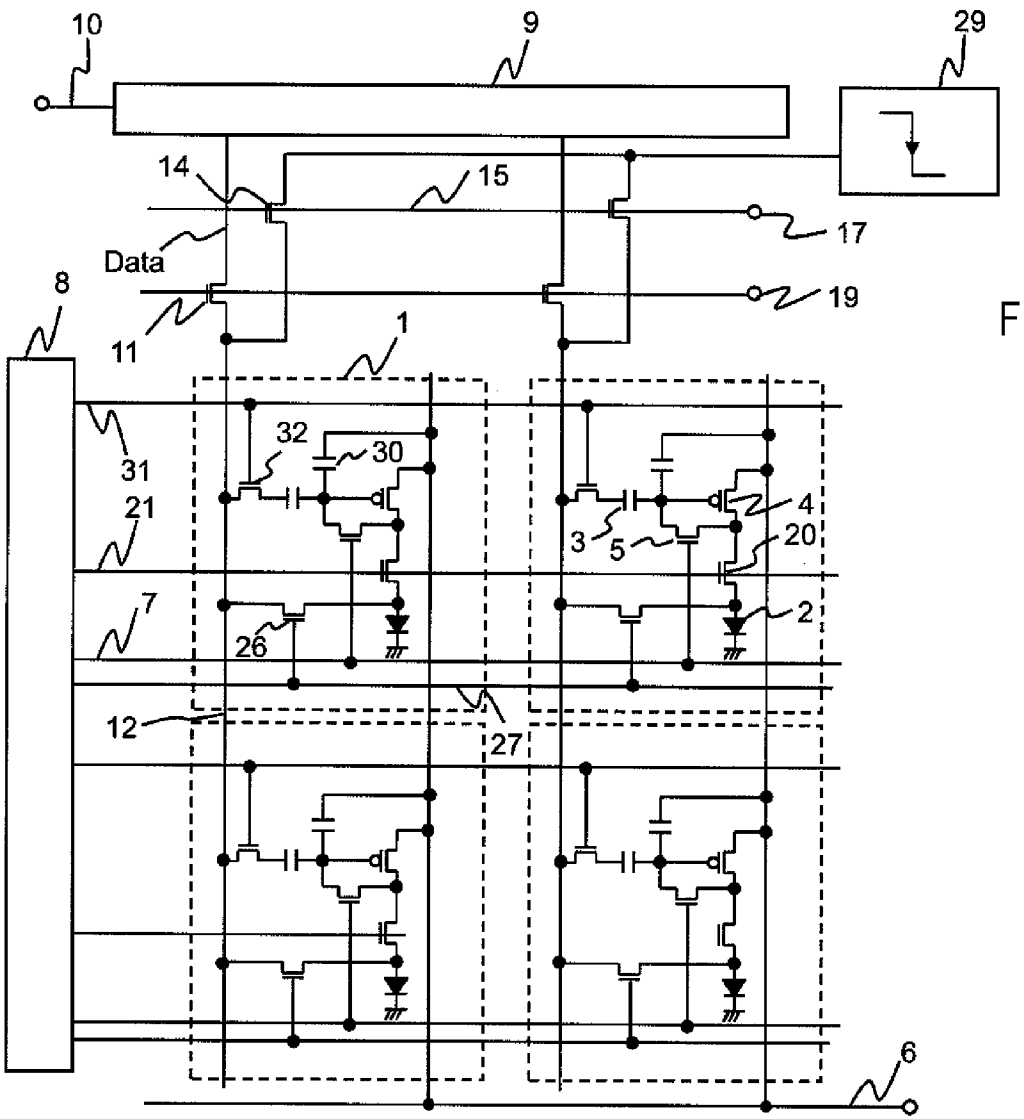
FIG. 3 is a diagram illustrating an entire structure of an organic EL display device according to Embodiment 2 of the present invention.

FIG. 3 is a diagram illustrating an entire structure of an organic EL display device according to Embodiment 2 of the present invention.

FIG. 3 is different from FIG. 1 in that the other end (anode electrode) of the organic EL element 2 is connected to the signal line 12 through a precharge switch element 26 controlled through a precharge line 27.

The organic EL display device according to this embodiment includes, in addition to the constituent elements of the organic EL display device according to Embodiment 1, the precharge switch elements 26. The precharge switch element 26 is used to apply a larger gate voltage ΔVg (that is, larger forward bias voltage) to the gate electrode of the driver TFT 4 before an image signal is written for each of the pixels 1.

Figure 4:
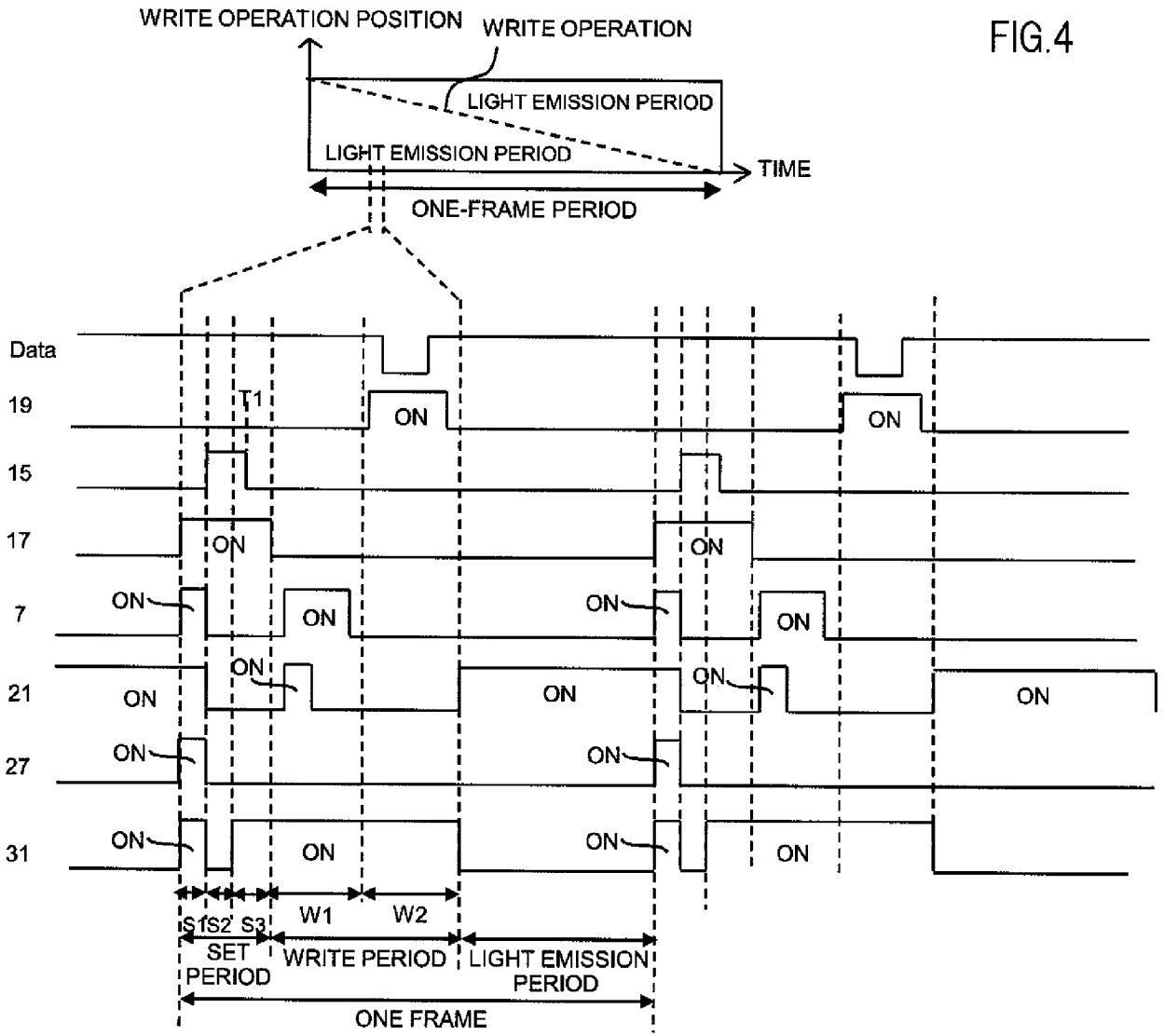
FIG. 4 is a timing chart illustrating an operation of the organic EL display device according to Embodiment 2 of the present invention.

FIG. 4 is a timing chart illustrating an operation of the organic EL display device according to this embodiment.

As illustrated in FIG. 4, also in this embodiment, a set period, a write period, and a light emission period are set within each frame period for each pixel.

Hereinafter, an operation during each of the periods is described.

[Set Period]

In this embodiment, during the "set period", the step signal selection switch control line 17 is in an H level, whereby the step signal selection switch element 14 is in an on-state.

During a period S1 of the set period, the reset switch element 5, the lighting control switch element 20, the select switch element 32, and the precharge switch element 26 are in an on-state.

In this case, the voltage Vstep1 is applied from the step signal generation section 29 to the signal line 12 through the step signal input line 15. The voltage Vstep1 is, for example, the minimum voltage of the voltages which can be supplied from the signal driver section 9, or the voltage of the common ground line. In this case, the voltage Vstep1 is applied to the gate electrode of the driver TFT 4.

During a period S2, the reset switch element 5, the lighting control switch element 20, the select switch element 32, and the precharge switch element 26 are in an off-state. In this case, the voltage Vsteph is applied from the step signal generation section 29 to the signal line 12 through the step signal input line 15. The voltage Vsteph is, for example, the maximum voltage of the voltages which can be supplied from the signal driver section 9, or the voltage of the power supply line 6. In this case, the gate electrode of the driver TFT 4 is maintained at the voltage Vstep1.

During a period S3, the select switch element 32 is in an on-state. At a time T1 within the period S3, the voltage output from the step signal generation section 29 is switched from the voltage Vsteph to the voltage Vstep1.

Therefore, during the period S3, the voltage supplied to the signal line 12 through the step signal input line 15 is changed from the voltage Vsteph to the voltage Vstep1.

In this case, a voltage of (Vstep1−Vsteph) [V] is applied to the gate electrode of the driver TFT 4. When the voltage of the power supply line 6 is expressed by Vdd, when the voltage of the common ground line is set to 0 [V], and when (Vsteph−Vstep1)≈Vdd is satisfied, the gate electrode of the driver TFT 4 can be maintained at a voltage of −(Vdd).

At the initial stage of the program operation, in the normal case, the initial voltage of only approximately (Vdd/2) can be applied between the gate electrode and the source electrode of the driver TFT 4. In contrast, according to this embodiment, a voltage of (2Vdd) can be applied between the gate electrode and the source electrode. Therefore, even when a driver TFT significantly affected by hysteresis is used as the driver TFT 4, the characteristic of the driver TFT can be fit to Characteristic-C1 illustrated in FIG. 14B to drive the driver TFT with the characteristic close to Characteristic-B. Thus, uniform light emission can be realized.

[Write Period and Light Emission Period]

The operation during the write period in this embodiment is identical to the operation during the write period in Embodiment 1 illustrated in FIG. 2, and hence the repeated description is omitted.

Similarly, the operation during the light emission period in this embodiment is identical to the operation during the light emission period in Embodiment 1 illustrated in FIG. 2, and hence the repeated description is omitted.

Modified Example 1 of Embodiment 2

Figure 5:
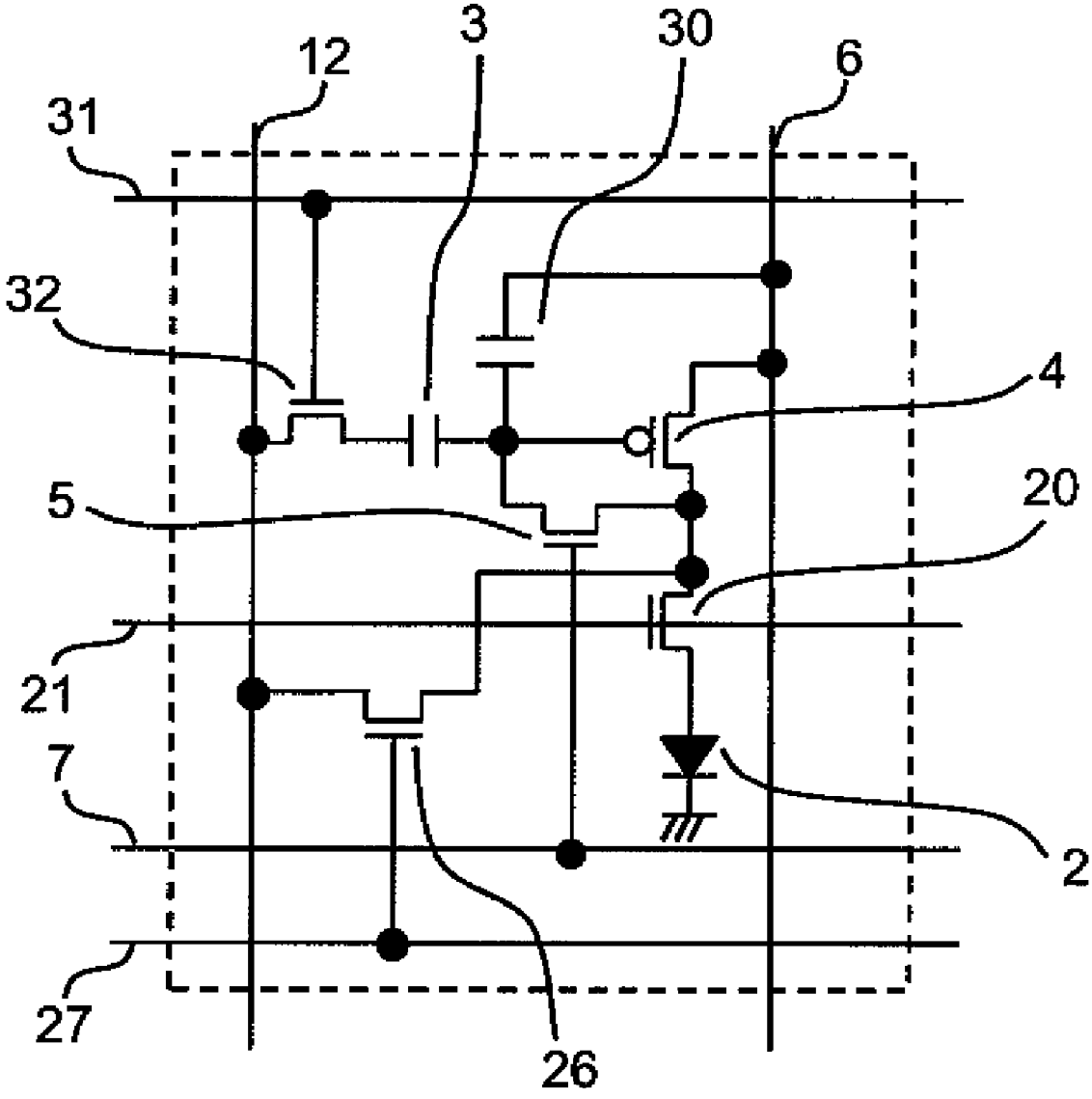
FIG. 5 is a circuit diagram illustrating an equivalent circuit of a pixel of an organic EL display device corresponding to Modified Example 1 of the organic EL display device according to Embodiment 2 of the present invention.

FIG. 5 is a circuit diagram illustrating an equivalent circuit of a pixel of an organic EL display device corresponding to Modified Example 1 of the organic EL display device according to Embodiment 2 of the present invention.

A pixel 1 illustrated in FIG. 5 is different from each of the pixels 1 illustrated in FIG. 3 in that the drain electrode of the driver TFT 4 is connected to the signal line 12 through the precharge switch element 26 controlled through the precharge line 27.

Figure 6:
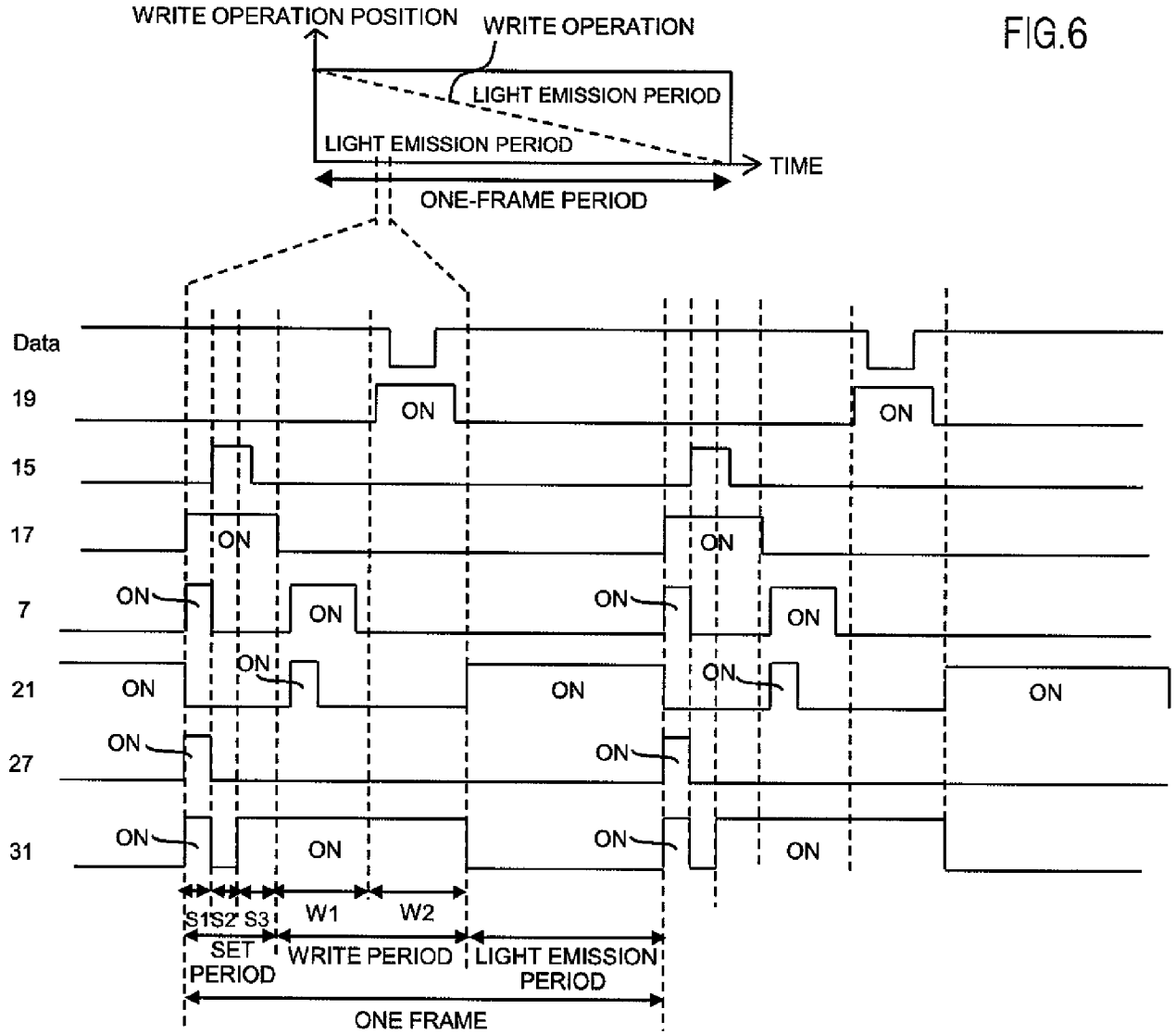
FIG. 6 is a timing chart illustrating an operation of the organic EL display device corresponding to Modified Example 1 of the organic EL display device according to Embodiment 2 of the present invention.

FIG. 6 is a timing chart illustrating an operation of the organic EL display device corresponding to Modified Example 1 of the organic EL display device according to Embodiment 2 of the present invention.

In Modified Example 1 of the organic EL display device according to Embodiment 2 of the present invention, the lighting control switch element 20 of each of the pixels 1 is maintained in an off-state during the periods S1 to S3 of the set period. However, the fundamental operation is the same as in the organic EL display device according to Embodiment 2 of the present invention. Similarly, the operations during the write period and the light emission period, of the organic EL display device corresponding to Modified Example 1 are the same as in the organic EL display device according to Embodiment 2 of the present invention.

Modified Example 2 of Embodiment 2

Figure 7:
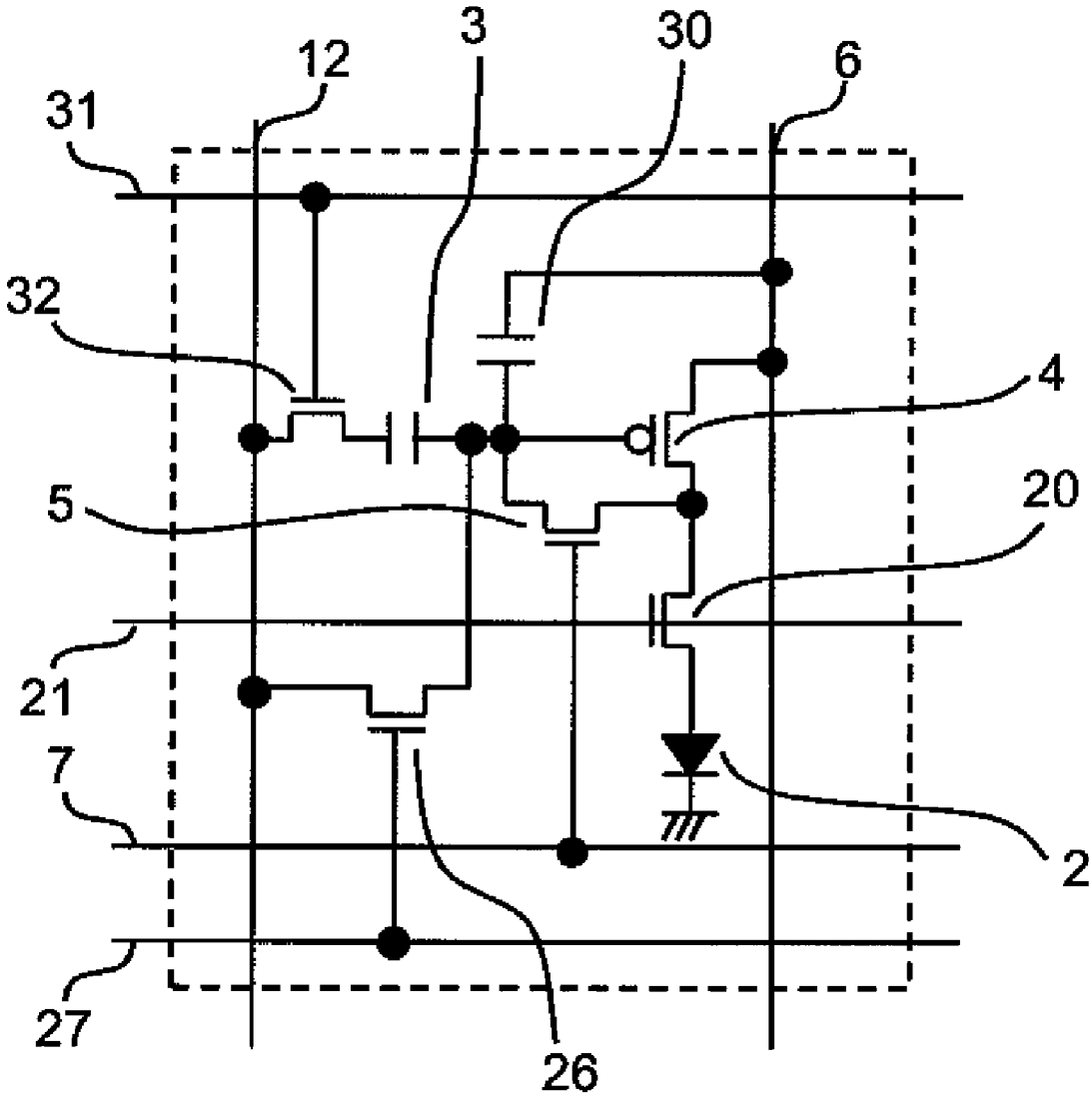
FIG. 7 is a circuit diagram illustrating an equivalent circuit of a pixel of an organic EL display device corresponding to Modified Example 2 of the organic EL display device according to Embodiment 2 of the present invention.

FIG. 7 is a circuit diagram illustrating an equivalent circuit of a pixel of an organic EL display device corresponding to Modified Example 2 of the organic EL display device according to Embodiment 2 of the present invention.

A pixel 1 illustrated in FIG. 7 is different from each of the pixels 1 illustrated in FIG. 3 in that the gate electrode of the driver TFT 4 is connected to the signal line 12 through the precharge switch element 26 controlled through the precharge line 27.

Figure 8:
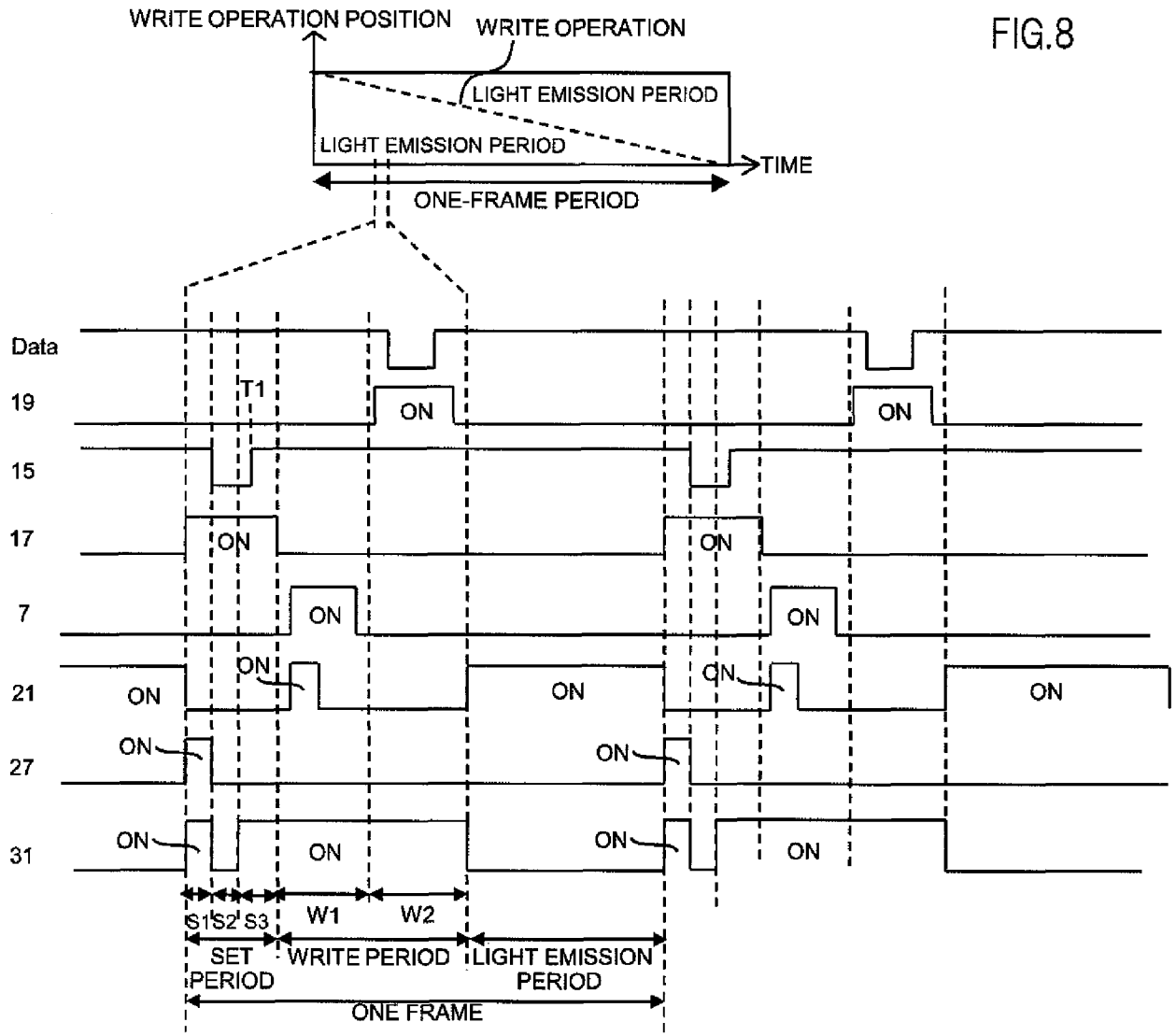
FIG. 8 is a timing chart illustrating an operation of the organic EL display device corresponding to Modified Example 2 of the organic EL display device according to Embodiment 2 of the present invention.

FIG. 8 is a timing chart illustrating an operation of the organic EL display device corresponding to Modified Example 2 of the organic EL display device according to Embodiment 2 of the present invention.

In Modified Example 2 of the organic EL display device according to Embodiment 2 of the present invention, the reset switch element 5 and the lighting control switch element 20 of each of the pixels 1 are maintained in an off-state during the periods S1 to S3 of the set period. However, the fundamental operation is the same as in the organic EL display device according to Embodiment 2 of the present invention. Similarly, the operations during the write period and the light emission period, of the organic EL display device corresponding to Modified Example 2 are the same as in the organic EL display device according to Embodiment 2 of the present invention.

Embodiment 3

Figure 9:
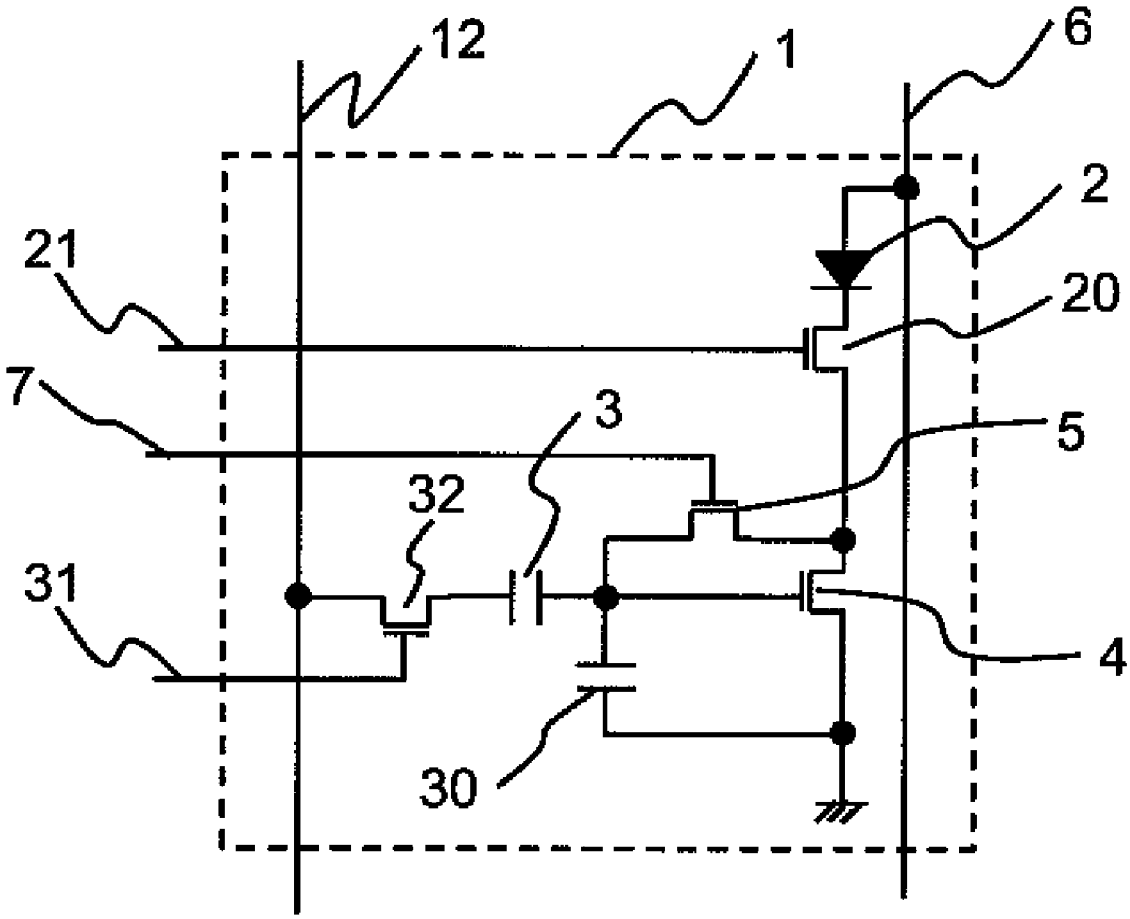
FIG. 9 is a circuit diagram illustrating an equivalent circuit of a pixel of an organic EL display device according to Embodiment 3 of the present invention.

FIG. 9 is a circuit diagram illustrating an equivalent circuit of a pixel of an organic EL display device according to Embodiment 3 of the present invention.

The organic EL display device according to this embodiment is different from the organic EL display device according to Embodiment 1 in that the anode electrode of the organic EL element 2 is directly connected to the power supply line 6 and that the driver TFT 4 is provided on the reference voltage side. Therefore, in the organic EL display device according to this embodiment, the reset switch element 5 is provided on the cathode side of the organic EL element 2.

In this embodiment, the driver TFT 4 is an n-type TFT. Therefore, all of the TFTs included in each pixel can be formed by only an n-type process.

The organic EL element 2 is provided on the power supply line 6 side, the driver TFT 4 is provided on the reference voltage side, and the related elements are shifted. Except for the point, the fundamental operation is the same as in the organic EL display device according to Embodiment 1.

Figure 10:
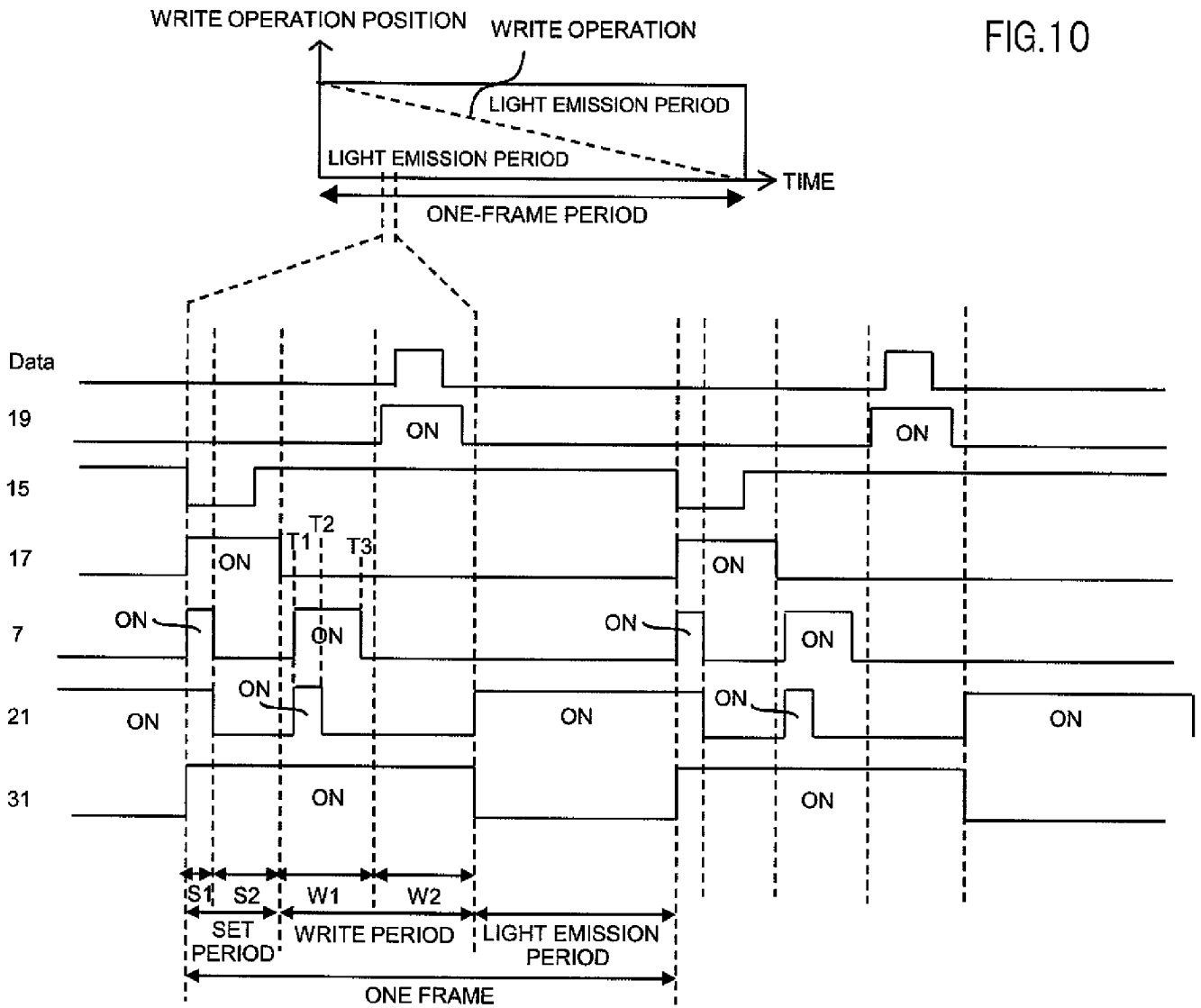
FIG. 10 is a timing chart illustrating an operation of the organic EL display device according to Embodiment 3 of the present invention.

FIG. 10 is a timing chart illustrating an operation of the organic EL display device according to this embodiment.

The timing chart of FIG. 10 is fundamentally identical to the timing chart of FIG. 2. However, an image signal supplied from the signal driver section 9 to the signal line Data is different in phase from the image signal in Embodiment 1 by 180°. The reason is that the driver TFT 4 in this embodiment is the n-type TFT, and the driver TFT 4 is turned on when the gate voltage becomes higher than the voltage of the source electrode.

During the period S1 of the set period, the reset switch element and the lighting control switch element 20 are in an on-state. During the period S1, the voltage Vstep1 is applied from the step signal generation section 29 to the step signal input line 15.

In this case, the step signal selection switch control line 17 is in an H level, and hence the step signal selection switch element 14 is in an on-state. Then, the voltage Vstep1 is applied to the signal line 12 through the step signal input line 15.

During the period S2 of the set period, the reset switch element 5 and the lighting control switch element 20 are in an off-state. As illustrated in FIG. 10, during the period S2, the voltage applied to the step signal input line 15 is changed by the step signal generation section 29 to the voltage Vsteph higher than the voltage Vstep1. Therefore, the voltage applied to the signal line 12 through the step signal input line 15 is changed from the voltage Vstep1 to the voltage Vsteph.

In this case, a voltage of "V1+(Vsteph−Vstep1)" [V] is applied to the gate electrode of the driver TFT 4. As described above, when the voltage of the power supply line 6 is expressed by Vdd and the voltage of the common ground line is set to 0 [V], V1≈Vdd/2. When (Vsteph−Vstep1)≈Vdd, the gate electrode of the driver TFT 4 can be maintained at a voltage of 3Vdd/2.

Therefore, at the first time T1 within the write period, the characteristic of the driver TFT 4 of each of the pixels 1 can be fit to Characteristic-C1 illustrated in FIG. 14B to use the driver TFT 4 with the characteristic close to Characteristic-B. Thus, uniform display can be achieved without display defect resulting from the hysteresis characteristic of the driver TFT 4.

Even in the case of the organic EL display device according to Embodiment 2, as in this embodiment, the n-type TFT can be provided as the driver TFT 4 and the TFTs included in each pixel can be formed by only the n-type process.

In the organic EL display device according to each of the embodiments, the step signal generation section 29 includes the low-temperature polycrystalline silicon TFT circuit and is formed on the glass substrate. The step signal generation section 29 may be formed in the signal driver section 9.

The step signal generation section 29 may be removed and the step signal may be input from an outside such as a main body computer side.

Figure 17:
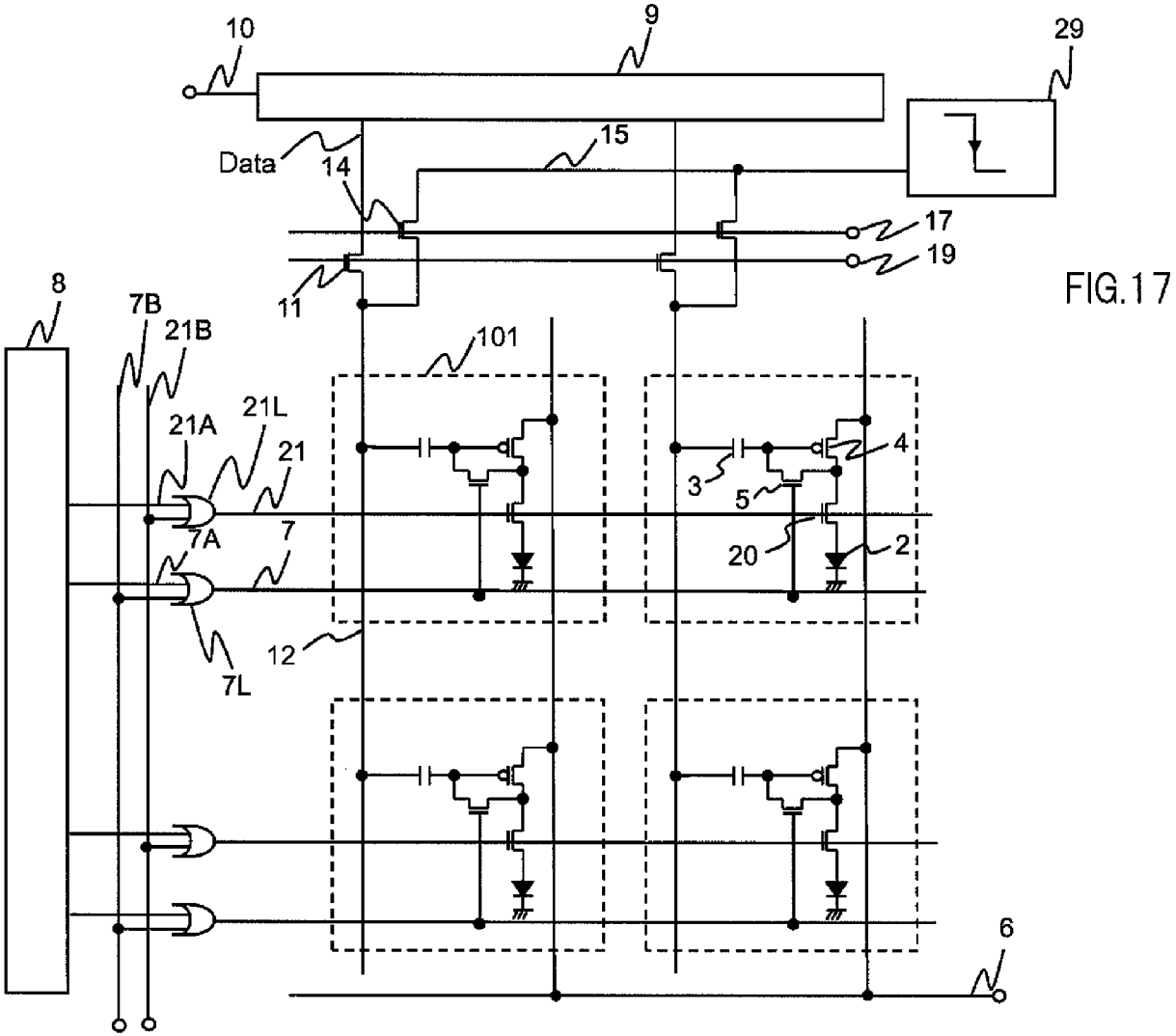
FIG. 17 is a diagram illustrating another entire structure of an organic EL display device according to Embodiment 1 of the present invention.

FIG. 17 is a diagram illustrating another entire structure of an organic EL display device according to Embodiment 1 of the present invention.

The present invention can be applied to a pixel circuit 101 in FIG. 17. The pixel circuit 101 is equivalent to a circuit where a first capacitor element 30 and a select switch element 32 are removed from the pixel circuit 1 in FIG. 1, and it is composed of only three TFT switches (a driver TFT 4, a reset switch element 5 and a lighting control switch element 20), a second capacitor element 3, and an organic EL element 2.

A logic element 7L selects that one corresponding Reset line 7 is connected to one corresponding address reset line 7A or an all reset control line 7B. The address reset line 7A controls the reset switch elements 5 in the pixel circuits 101 selected by a gate driver section 8. The all reset control line 7B controls the reset switch element 5 in each of the pixel circuits 101 in FIG. 17.

A logic element 21L selects that one corresponding lighting switch line 21 is connected to one corresponding address lighting line 21A or an all lighting control line 21B. The lighting line 21A controls a lighting control switch element 20 in the pixel circuit 101 selected by the gate driver section 8. The all lighting control line 21B controls the lighting control switch elements 20 in each of the pixel circuits 101 in FIG. 17.

As described in Embodiment 1, a voltage of "V1≈(Vsteph−Vstep1)" [V] is applied to the gate electrode of the driver TFT 4. When the voltage of the power supply line 6 is expressed by Vdd and the voltage of the common ground line is set to 0 [V], V1≈Vdd/2 is satisfied. In a case of (Vsteph−Vstep1)≈Vdd, the gate electrode of the driver TFT 4 can be maintained at a voltage of −(Vdd/2).

Figure 15B:
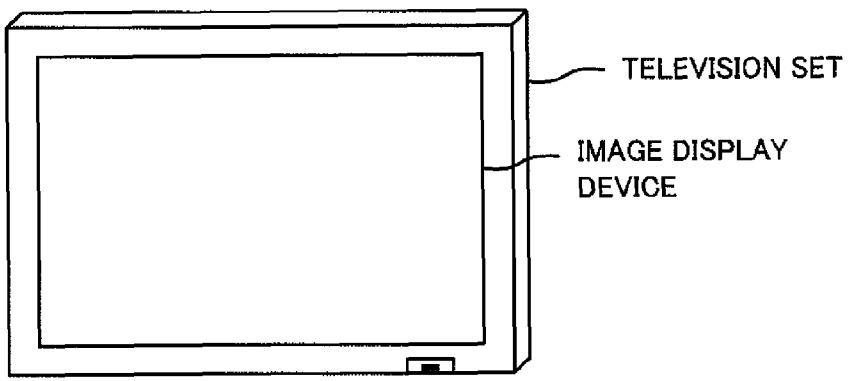
FIGS. 15A and 15B illustrate image display devices each including the organic EL display device according to any one of the embodiments of the present invention.
Figure 15A:
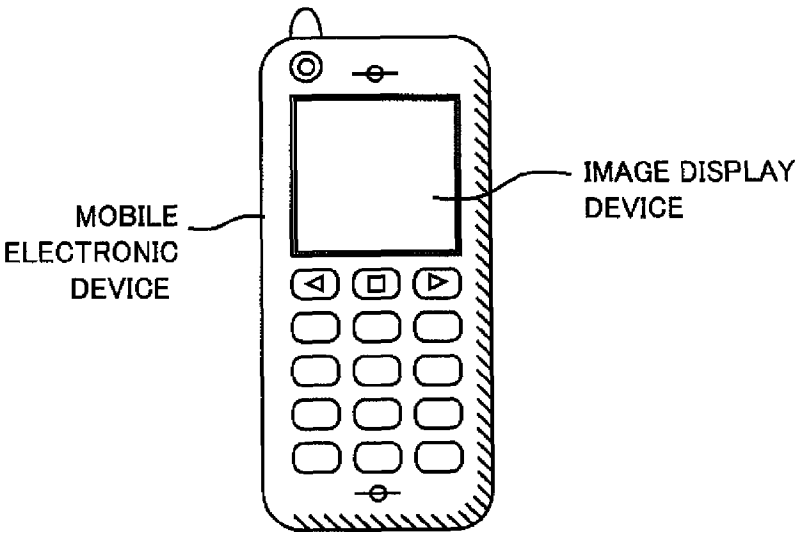
Figure 16B:
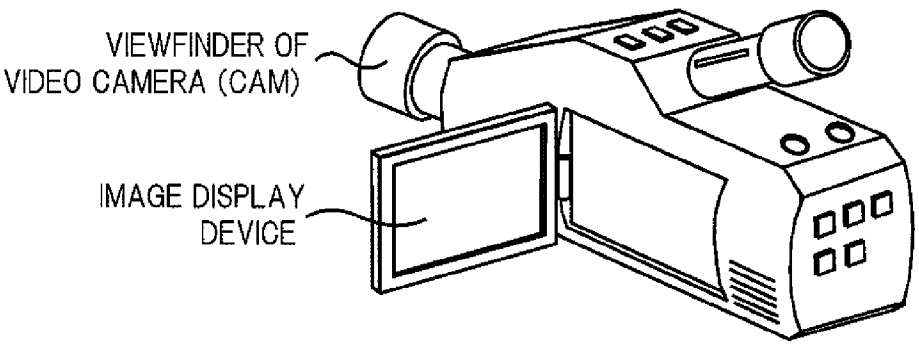
FIGS. 16A and 16B illustrate image display devices each including the organic EL display device according to any one of the embodiments of the present invention.
Figure 16A:
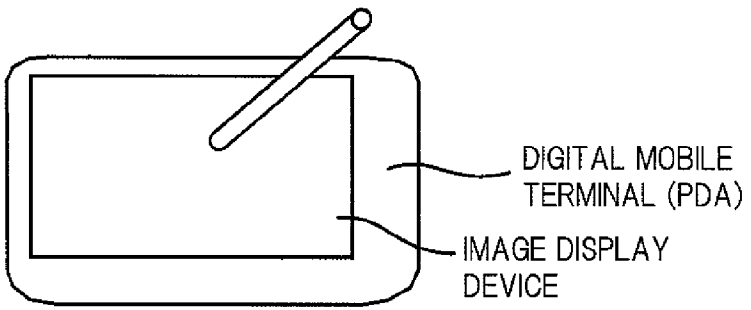

When the image display device according to the present invention as described above is mounted on a mobile electronic device (FIG. 15A), a television set (FIG. 15B), a digital mobile terminal (PDA) (FIG. 16A), or a video camera (FIG. 16B), a high-image quality product for moving picture can be realized.

While there have been described what are at present considered to be certain embodiments of the invention, it would be understood that various modifications may be made thereto, and it is intended that the appended claims cover all such modifications as fall within the true spirit and scope of the invention.

What is claimed is:

1. An image display device, comprising:

a plurality of pixels each including a light-emitting element having a first end and a second end;

a plurality of signal lines for inputting image signals to the plurality of pixels;

a signal driver section for supplying the image signals to the plurality of signal lines; and a step signal generation circuit for supplying a step signal to each of the plurality of signal lines, each of the plurality of pixels including:

a driver transistor which includes a control electrode, a first electrode, and a second electrode, for driving the light-emitting element based on corresponding one of the image signals;

a capacitor element connected between a corresponding one of the plurality of signal lines and the control electrode of the driver transistor; and a reset switch element connected between the control electrode and the second electrode of the driver transistor, the first electrode of the driver transistor being applied with a first power supply voltage, the first end of the light-emitting element being applied with a second power supply voltage, wherein:

a frame period includes: a set period; and a write period which follows the set period, for writing the image signals to the plurality of pixels on each of a plurality of display lines;

during a first period of the set period, the reset switch element of each of the plurality of pixels on the corresponding display line is turned on to converge a voltage at the control electrode of the driver transistor of each of the plurality of pixels on the corresponding display line to a predetermined voltage, and a step signal having a first voltage level is supplied from the step signal generation circuit to each of the plurality of signal lines; and during a second period of the set period, the reset switch element of each of the plurality of pixels on the corresponding display line is turned off, and a step signal having a second voltage level different from the first voltage level is supplied from the step signal generation circuit to each of the plurality of signal lines, to input, to the control electrode of the driver transistor of each of the plurality of pixels on the corresponding display line, a characteristic value set voltage which is one of a first set voltage and a second set voltage wherein:

the first set voltage is a voltage lower in potential than the second power supply voltage when the first power supply voltage is higher than the second power supply voltage, or a voltage higher in potential than the second power supply voltage when the first power supply voltage is lower than the second power supply voltage;

the second set voltage is a voltage lower in potential than a minimum voltage in a voltage range supplied from the signal driver section when the first power supply voltage is higher than the second power supply voltage, or a voltage higher in potential than a maximum voltage in the voltage range supplied from the signal driver section when the first power supply voltage is lower than the second power supply voltage.

2. An image display device according to claim 1, wherein:

each of the plurality of pixels further comprises a lighting control switch element connected between the second electrode of the driver transistor and the second end of the light-emitting element;

during the first period of the set period, the reset switch element and the lighting control switch element of each of the plurality of pixels on the corresponding display line are turned on to converge a voltage at the control electrode of the driver transistor of each of the plurality of pixels on the corresponding display line to the predetermined voltage, and the step signal having the first voltage level is supplied from the step signal generation circuit to each of the plurality of signal lines; and during the second period of the set period, the reset switch element and the lighting control switch element of each of the plurality of pixels on the corresponding display line are turned off, and the step signal having the second voltage level is supplied from the step signal generation circuit to each of the plurality of signal lines, to input the characteristic value set voltage to the control electrode of the driver transistor of each of the plurality of pixels on the corresponding display line.

3. An image display device according to claim 1, wherein:

each of the plurality of pixels on the corresponding display line further comprises a precharge switch element connected between the corresponding one of the plurality of signal lines and the second-end of the light-emitting element; and during the first period of the set period, the precharge switch element and the reset switch element of each of the plurality of pixels on the corresponding display line are turned on, and the step signal having the first voltage level is supplied from the signal driver section to each of the plurality of signal lines to input the step signal having the first voltage level to the control electrode of the driver transistor of each of the plurality of pixels on the corresponding display line.

4. An image display device according to claim 3, wherein:

each of the plurality of pixels further comprises a lighting control switch element connected between the second electrode of the driver transistor and the second end of the light-emitting element; and during the first period of the set period, the precharge switch element, the lighting control switch element, and the reset switch element of each of the plurality of pixels on the corresponding display line are turned on, and the step signal having the first voltage level is supplied from the signal driver section to each of the plurality of signal lines to input the step signal having the first voltage level to the control electrode of the driver transistor of each of the plurality of pixels on the corresponding display line.

5. An image display device according to claim 1, wherein the step signal generation circuit can adjust: one of the first voltage level and the second voltage level of the step signal; and a step width of the one of the first voltage level and the second voltage level of the step signal.

6. An image display device according to claim 1, wherein:

the driver transistor comprises a p-type field effect transistor;

the light-emitting element includes a cathode electrode applied with the second power supply voltage;

the first voltage level of the step signal is a High level and the second voltage level of the step signal is a Low level; and the characteristic value set voltage input to the control electrode of the driver transistor of each of the plurality of pixels on the corresponding display line is one of the first set voltage and the second set voltage wherein the first set voltage is a voltage lower in potential than the second power supply voltage and the second set voltage is a voltage lower in potential than the minimum voltage in the voltage range supplied from the signal driver section.

7. An image display device according to claim 1, wherein:

the driver transistor comprises an n-type field effect transistor;

the light-emitting element includes an anode electrode applied with the second power supply voltage;

the first voltage level of the step signal is a Low level and the second voltage level of the step signal is a High level; and the characteristic value set voltage input to the control electrode of the driver transistor of each of the plurality of pixels on the corresponding display line is one of the first set voltage and the second set voltage wherein the first set voltage is a voltage higher in potential than the second power supply voltage and the second set voltage is a voltage higher in potential than the maximum voltage in the voltage range supplied from the signal driver section.

8. An image display device according to claim 1, wherein:

the write period includes a precharge period for inputting a precharge voltage to each of the plurality of pixels on the corresponding display line and an image signal write period which follows the precharge period, for inputting the image signals to the plurality of pixels on the corresponding display line; and during the precharge period, the reset switch element of each of the plurality of pixels on the corresponding display line is turned on, and the precharge voltage is supplied from the signal driver section to each of the plurality of signal lines to input the precharge voltage to the control electrode of the driver transistor of each of the plurality of pixels on the corresponding display line.

9. An image display device, comprising:

a plurality of pixels each including a light-emitting element having a first end and a second end;

a plurality of signal lines for inputting image signals to the plurality of pixels;

a signal driver section for supplying the image signals to the plurality of signal lines; and a step signal generation circuit for supplying a step signal to each of the plurality of signal lines, each of the plurality of pixels including:

a driver transistor which includes a control electrode, a first electrode, and a second electrode, for driving the light-emitting element based on corresponding one of the image signals;

a first capacitor element connected between the control electrode and the first electrode of the driver transistor;

a second capacitor element having a first end and a second end, the first end being connected to the control electrode of the driver transistor;

a select switch element connected between a corresponding one of the plurality of signal lines and the second end of the second capacitor element; and a reset switch element connected between the control electrode and the second electrode of the driver transistor, the first electrode of the driver transistor being applied with a first power supply voltage, the first end of the light-emitting element being applied with a second power supply voltage, wherein:

a frame period includes: a set period; and a write period which follows the set period, for writing the image signals to the plurality of pixels on each of a plurality of display lines;

during a first period of the set period, the select switch element and the reset switch element of each of the plurality of pixels on the corresponding display line are turned on to converge a voltage at the control electrode of the driver transistor of each of the plurality of pixels on the corresponding display line to a predetermined voltage, and a step signal having a first voltage level is supplied from the step signal generation circuit to the corresponding one of the plurality of signal lines, which is connected to the select switch element of each of the plurality of pixels on the corresponding display line; and during a second period of the set period, the select switch element of each of the plurality of pixels on the corresponding display line is turned on, the reset switch element of each of the plurality of pixels on the corresponding display line is turned off, and a step signal having a second voltage level different from the first voltage level is supplied from the step signal generation circuit to each of the plurality of signal lines, to input, to the control electrode of the driver transistor of each of the plurality of pixels on the corresponding display line, a characteristic value set voltage which is one of a first set voltage and a second set voltage wherein:

the first set voltage is a voltage lower in potential than the second power supply voltage when the first power supply voltage is higher than the second power supply voltage, or a voltage higher in potential than the second power supply voltage when the first power supply voltage is lower than the second power supply voltage; and the second set voltage is a voltage lower in potential than a minimum voltage in a voltage range supplied from the signal driver section when the first power supply voltage is higher than the second power supply voltage, or a voltage higher in potential than a maximum voltage in the voltage range supplied from the signal driver section when the first power supply voltage is lower than the second power supply voltage.

10. An image display device according to claim 9, wherein:

each of the plurality of pixels further comprises a lighting control switch element connected between the second electrode of the driver transistor and the second end of the light-emitting element;

during the first period of the set period, the select switch element, the reset switch element, and the lighting control switch element of each of the plurality of pixels on the corresponding display line are turned on to converge a voltage at the control electrode of the driver transistor of each of the plurality of pixels on the corresponding display line to the predetermined voltage, and the step signal having the first voltage level is supplied from the step signal generation circuit to each of the plurality of signal lines; and during the second period of the set period, the select switch element of each of the plurality of pixels on the corresponding display line is turned on, the reset switch element and the lighting control switch element of each of the plurality of pixels on the corresponding display line are turned off, and the step signal having the second voltage level is supplied from the step signal generation circuit to each of the plurality of signal lines, to input the characteristic value set voltage to the control electrode of the driver transistor of each of the plurality of pixels on the corresponding display line.

11. An image display device according to claim 9, wherein:

the driver transistor comprises a p-type field effect transistor;

the light-emitting element includes a cathode electrode applied with the second power supply voltage;

the first voltage level of the step signal is a High level and the second voltage level of the step signal is a Low level; and the characteristic value set voltage input to the control electrode of the driver transistor of each of the plurality of pixels on the corresponding display line is one of a voltage lower in potential than the second power supply voltage and a voltage lower in potential than a minimum voltage in the voltage range supplied from the signal driver section.

12. An image display device, comprising:

a plurality of pixels each including a light-emitting element having a first end and a second end;

a plurality of signal lines for inputting image signals to the plurality of pixels;

a signal driver section for supplying the image signals to the plurality of signal lines; and a step signal generation circuit for supplying a step signal to each of the plurality of signal lines, each of the plurality of pixels including:

a driver transistor which includes a control electrode, a first electrode, and a second electrode, for driving the light-emitting element based on corresponding one of the image signals;

a first capacitor element connected between the control electrode and the first electrode of the driver transistor;

a second capacitor element having a first end and a second end, the first end being connected to the control electrode of the driver transistor;

a select switch element connected between a corresponding one of the plurality of signal lines and the second end of the second capacitor element;

a reset switch element connected between the control electrode and the second electrode of the driver transistor;

a lighting control switch element connected between the second electrode of the driver transistor and the first end of the light-emitting element; and a precharge switch element connected between the corresponding one of the plurality of signal lines and the first end of the light-emitting element, the first electrode of the driver transistor being applied with a first power supply voltage, the second end of the light-emitting element being applied with a second power supply voltage, wherein:

a frame period includes: a set period; and a write period which follows the set period, for writing the image signals to the plurality of pixels on each of a plurality of display lines;

during a first period of the set period, the select switch element, the reset switch element, the lighting control switch element, and the precharge switch element of each of the plurality of pixels on the corresponding display line are turned on, and a step signal having a second voltage level is supplied from the step signal generation circuit to the corresponding one of the plurality of signal lines, which is connected to the select switch element of each of the plurality of pixels on the corresponding display line, to input a voltage having the second voltage level to the control electrode of the driver transistor of each of the plurality of pixels on the corresponding display line;

during a second period of the set period, the select switch element, the reset switch element, the lighting control switch element, and the precharge switch element of each of the plurality of pixels on the corresponding display line are turned off, and a step signal having a first voltage level different from the second voltage level is supplied from the step signal generation circuit to each of the plurality of signal lines; and during a third period of the set period, the select switch element of each of the plurality of pixels on the corresponding display line is turned on, the reset switch element, the lighting control switch element, and the precharge switch element of each of the plurality of pixels on the corresponding display line are turned off, and a step signal having the second voltage level is supplied from the step signal generation circuit to each of the plurality of signal lines for each of the plurality of pixels on the corresponding display line, to input, to the control electrode of the driver transistor of each of the plurality of pixels on the corresponding display line, a characteristic value set voltage which is one of a first set voltage and a second set voltage wherein:

the first set voltage is a voltage lower in potential than the second power supply voltage when the first power supply voltage is higher than the second power supply voltage, or a voltage higher in potential than the second power supply voltage when the first power supply voltage is lower than the second power supply voltage; and the second set voltage is a voltage lower in potential than a minimum voltage in a voltage range supplied from the signal driver section when the first power supply voltage is higher than the second power supply voltage, or a voltage higher in potential than a maximum voltage in the voltage range supplied from the signal driver section when the first power supply voltage is lower than the second power supply voltage.

13. An image display device according to claim 12, wherein:

the driver transistor comprises a p-type field effect transistor;

the light-emitting element includes a cathode electrode applied with the second power supply voltage;

the first voltage level of the step signal is a High level and the second voltage level of the step signal is a Low level; and the characteristic value set voltage input to the control electrode of the driver transistor of each of the plurality of pixels on the corresponding display line is one of a voltage lower in potential than the second power supply voltage and a voltage lower in potential than a minimum voltage in the voltage range supplied from the signal driver section.

* * * * *